US007039335B2

(12) United States Patent
Matsuno et al.

(10) Patent No.: US 7,039,335 B2
(45) Date of Patent: May 2, 2006

(54) TEMPERATURE SENSOR, HEAT FIXING DEVICE, AND IMAGE FORMING DEVICE

(75) Inventors: Takuji Matsuno, Ichinomiya (JP); Seiichi Senda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/455,346

(22) Filed: Jun. 6, 2003

(65) Prior Publication Data

US 2003/0231894 A1 Dec. 18, 2003

(30) Foreign Application Priority Data

Jun. 14, 2002 (JP) ..... 2002-173632

(51) Int. Cl.
*G03G 15/00* (2006.01)
*G03G 15/20* (2006.01)

(52) U.S. Cl. ..... 399/69; 399/44

(58) Field of Classification Search ..... 399/44, 399/67, 69, 33, 320, 328, 335; 374/100, 374/153

See application file for complete search history.

(56) References Cited

U.S. PATENT DOCUMENTS 5,281,793 A * 1/1994 Gavin et al. ..... 374/153
5,287,155 A * 2/1994 Arai et al. ..... 399/69
5,299,870 A * 4/1994 Moritani ..... 374/153
5,585,896 A * 12/1996 Yamazaki et al. ..... 399/44
5,765,075 A * 6/1998 Yamamoto ..... 399/69
6,167,216 A * 12/2000 Hori ..... 399/69

FOREIGN PATENT DOCUMENTS

| | | |
|---|---|---|
| JP | U-59-42932 | 3/1984 |
| JP | A-2-114135 | 4/1990 |
| JP | 5-33167 | 4/1993 |
| JP | A-9-105683 | 4/1997 |
| JP | 2001-92292 | 4/2001 |

* cited by examiner

*Primary Examiner*—Sandra L. Brase
(74) *Attorney, Agent, or Firm*—Oliff & Berridge, PLC

(57) ABSTRACT

A temperature sensor for detecting the temperature of a heating roller contacts the heating roller with the bottom surface of a contact section provided on the front end of the temperature sensor. A temperature detecting element is disposed on the upper surface of the front end at a position corresponding to the contact section. The front edge of the sensor is bent away from the heating roller. During a printing process, a portion of the toner that is liquefied in the heat fixing process remains on the heating roller and is subsequently deposited on the bottom surface of the contact plate as the heating roller rotates. However, by forming the surface from the contact section to the front edge as a smooth curved surface to eliminate edges or corners that can lead to the accumulation of toner, a clump of toner does not form on the bottom surface of the contact plate.

26 Claims, 15 Drawing Sheets

TEMPERATURE SENSOR, HEAT FIXING DEVICE, AND IMAGE FORMING DEVICE

BACKGROUND OF THE INVENTION

1. Field of the Invention

The present invention relates to a temperature sensor for detecting the surface temperature of a heating roller of a thermal fixing device in an image forming device, such as a printer, copying machine, facsimile machine, and a multifunction device.

2. Description of the Related Art

Image forming devices, such as printers, copying machines, facsimile machines, and multifunction devices include a thermal fixing device for fixing images onto the surface of a recording medium such as a paper sheet. The thermal fixing device includes a heating roller with a built-in halogen lamp or other heating source. A temperature sensor having a temperature detecting element is disposed in contact with the outer surface of the heating roller in order to detect and control the temperature of the heating roller.

FIG. 1 shows an example of a temperature sensor 260 used in a conventional thermal fixing device. The temperature sensor 260 includes a contact plate 265 and a temperature detecting element 264. The contact plate 265 is substantially rectangular in shape. The temperature detecting element 264 is fixed by adhesive 264*c* to the upper surface of the contact plate 265 near one lengthwise end of the contact plate 265. Plate-shaped side edges 265*f* and 265*g* are disposed one on each widthwise edge of the contact plate 265. The side edges 265*f* and 265*g* form an obtuse angle with upper surface of the contact plate 265 on which the temperature detecting element 264 is fixed.

As shown in FIG. 2, the temperature sensor 260 is supported in contact with a heating roller 241 of the thermal fixing device. The heating roller 241 rotates from left to right in FIG. 2 as indicated by an arrow. Although not shown in the drawings, the temperature sensor 260 is fixed to a frame of the thermal fixing device. The temperature sensor 260 is oriented with the fixed end located upstream, and the free end located downstream, with respect to the rotation direction of the heating roller 241. The lower surface of the contact plate 265, that is, the opposite that on which the temperature detecting element 264 is fixed, contacts the heating roller 241.

SUMMARY OF THE INVENTION

Toner liquefied by heat in the fixing process may cling to the heating roller 241 and be transported to the contact plate 265 by rotation of the heating roller 241. This liquefied toner may cling to the contact plate 265 at the position where the contact plate 265 contacts the heating roller 241. If liquefied toner repeatedly moves onto the contact plate 265, the corner edge between a tip 265*k* and the lower surface of the contact plate 265 activates build up of the toner on a tip 265*k* of the contact plate 265. The toner gradually builds up, forming a clump of toner on the tip 265*k*. After growing to a certain size, this clump of toner drops from the tip 265*k* onto the surface of the heating roller 241 and appears in the image being fixed on the recording medium as a spot or distortion in the image.

It is an object of the present invention to provide a temperature sensor, thermal fixing device, and image forming device capable of preventing a clump of foreign matter from accumulating on the contact plate of the temperature sensor.

In order to achieve the above-described object, a temperature sensor according to the present invention includes a support member and a temperature detecting element. The temperature sensor is attached to an attachment member and used in contact with an object.

The support member includes an attachment section, a contact section, and a bend. The attachment section and the bend are on opposite ends of the contact section. The attachment section is for attaching to the attachment member. The contact section has an upper surface and a lower surface that are opposite surfaces of the contact section and that are separated from each other in a direction from the lower surface to the upper surface of the contact section. The lower surface of the contact section is for contacting the object. The bend has a lower surface that slants away from the lower surface of the contact section in the direction from the lower surface to the upper surface of the contact section.

The temperature detecting element is for detecting the temperature of the object. The temperature detecting element is fixed on the support member.

A heat fixing device according to the present invention is for fixing a medium to another medium and includes an attachment member, a thermal fixing member, and a temperature sensor.

The thermal fixing member generates heat for thermally fixing the medium to the other medium.

The temperature sensor includes a support member and a temperature detecting element.

The support member has an attachment section, a contact section, and a bend. The attachment section and the bend are on opposite ends of the contact section. The contact section has an upper surface and a lower surface that are opposite surfaces of the contact section and that are separated from each other in a direction from the lower surface to the upper surface of the contact section. The attachment section is attached to the attachment member with the lower surface of the contact section in contact with the thermal fixing member. The bend has a lower surface that slants away from the lower surface of the contact section in the direction from the lower surface to the upper surface of the contact section.

The temperature detecting element is for detecting the temperature of the thermal fixing member. The temperature detecting element is fixed on the support member.

An image forming device according to the present invention is for forming a developer image on a recording medium and includes a processing unit and a heat fixing device. The processing unit transfers the developer image onto the recording medium. The heat fixing device is for fixing the developer image on the recording medium.

The heat fixing device includes an attachment member, a thermal fixing member that generates heat for thermally fixing the developer image on the recording medium, and a temperature sensor. The temperature sensor has a support member and a temperature detecting element.

The support member has an attachment section, a contact section, and a bend. The attachment section and the bend are on opposite ends of the contact section. The contact section has an upper surface and a lower surface that are opposite surfaces of the contact section and that are separated from each other in a direction from the lower surface to the upper surface of the contact section. The attachment section is attached to the attachment member with the lower surface of the contact section in contact with the thermal fixing member. The bend has a lower surface that slants away from the lower surface of the contact section in the direction from the lower surface to the upper surface of the contact section.

The temperature detecting element is for detecting the temperature of the thermal fixing member. The temperature detecting element is fixed on the support member.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Figure 1:
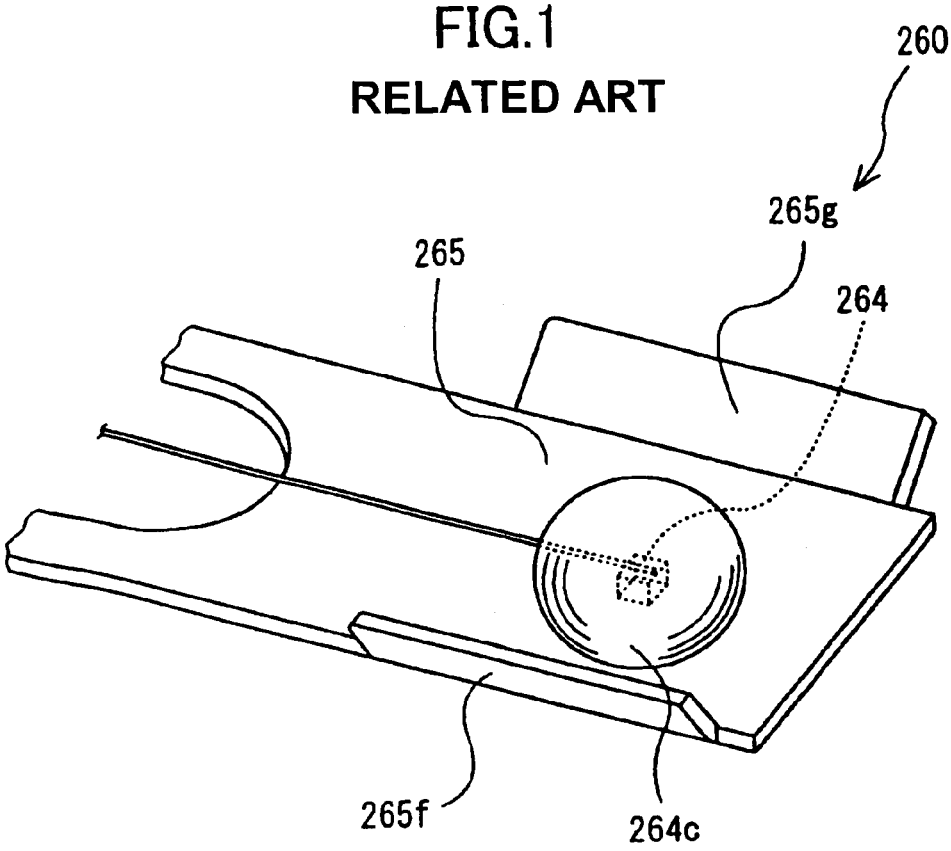
FIG.1 RELATED ART
FIG. 1 is an enlarged perspective view showing an end portion of a conventional temperature sensor.
Figure 2:
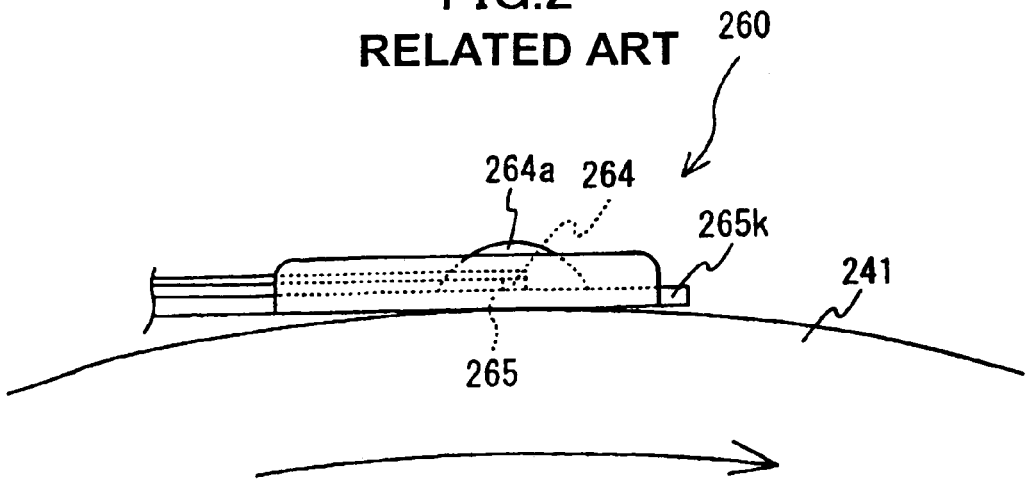
FIG.2 RELATED ART
FIG. 2 is an enlarged side view showing the contact area between the end portion of the conventional temperature sensor and a heating roller.
Figure 3:
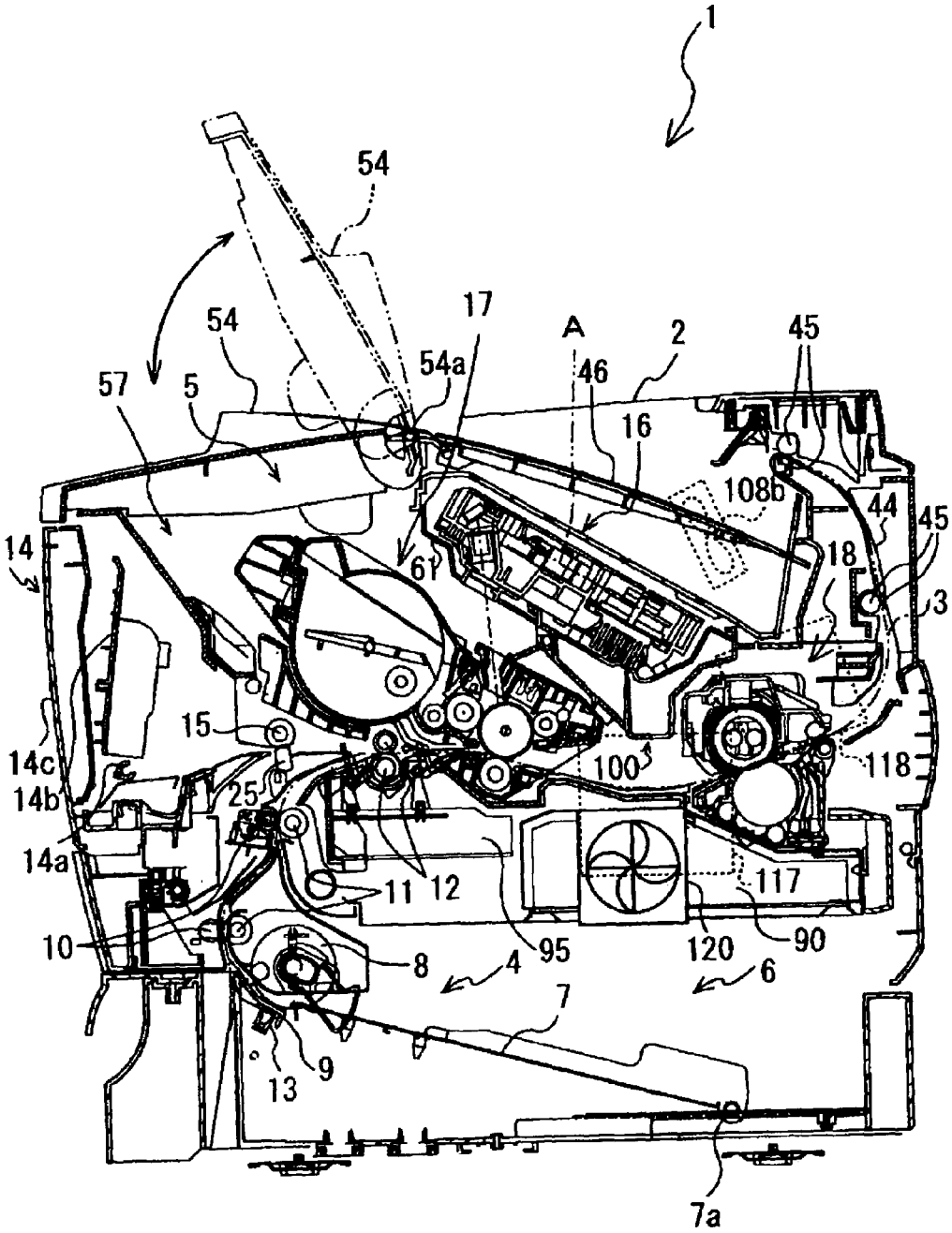
FIG. 3 is a center cross-sectional view of a laser printer according to the embodiment.

A laser printer 1 according to an embodiment of the present invention will be described with reference to the accompanying drawings. First, overall structure of the laser printer 1 will be described with reference to FIG. 3. FIG. 3 is a central sectional view of the laser printer 1. As shown in FIG. 3, the laser printer 1 includes a feeder section 4 and an image forming section 5. The feeder section 4 is for feeding a sheet 3. The image forming section 5 is for forming a predetermined image on the fed sheet 3 in a main body case 2. Note that the left side of FIG. 3 is the front surface of the laser printer 1.

A sheet delivery tray 46 is formed in a recessed shape and located to a rear upper surface of the main case body 2. Printed sheets 3 are discharged from the laser printer 1 into a stack on the tray 46. A cartridge receiving section 57 in which a process cartridge 17 is inserted is provided in a portion close to the front upper surface of the main body case 2. The cartridge receiving section 57 opens upward. An upper surface cover 54 that pivots vertically around a shaft 54a is provided on a front end side of the sheet delivery tray 46. The cover 54 is for covering the cartridge receiving section 57. Note that the open position of the upper surface cover 54 is indicated by an alternate long and two short dash lines in FIG. 3.

A sheet delivery path 44 is provided at the rear part in the main body case 2 (right side in FIG. 3). The sheet delivery path 44 is formed in a semi-arc shape that extends vertically along the back of the main body case 2. The sheet delivery path 44 delivers the sheet 3 from a fixing device 18 of the image forming section 5, which is provided on a rear end side in a lower part of the main body case 2, to the sheet delivery tray 46. A sheet delivery roller 45 for conveying the sheet 3 is provided along the sheet delivery path 44. Note that face down sheet delivery can be performed because the sheet delivery path 44 is formed in a semi-arc shape. In face down delivery, the sheet 3 having an image printed on its upper surface is delivered onto the sheet delivery tray 46 with the printed surface facing downward. Because the sheets 3 are stacked in the order of delivery with a printed surface facing downward, a plurality of sheets 3 that are printed in succession can be arranged in the order of printing when images are formed on a plurality of sheets.

The feeder section 4 includes a sheet feed roller 8, a sheet feed tray 6, a sheet pressing plate 7, a separation pad 9, paper powder removing rollers 10, conveying rollers 11, and registration rollers 12. The sheet feed roller 8 is provided in a bottom part of the main body case 2 at a position above one end of the sheet feed tray 6. The sheet feed tray 6 is detachably mounted. The sheet pressing plate 7 is provided in the sheet feed tray 6. The sheets 3 are stacked on the sheet pressing plate 7. The sheet pressing plate 7 presses the sheets 3 into contact with the sheet feed roller 8. The separation pad 9 is pressed toward the sheet feed roller 8, nips and conveys the sheets 3 in cooperation with the sheet feed roller 8 at the time of sheet feed, and prevents double feed of the sheets 3. The conveying rollers 11 are provided downstream from the sheet feed roller 8 with respect to a conveying direction of the sheets 3. The conveying rollers 11 perform conveyance of the sheets 3. The paper powder removing rollers 10 come into contact with the respective conveying rollers 11 with the sheet 3 therebetween to remove paper powder and also convey the sheets 3 in cooperation with the conveying rollers 11. The registration rollers 12 are provided downstream from the conveying rollers 11 with respect to the conveying direction of the sheets 3 and adjust timing for delivering the sheets 3 at the time of printing.

The sheets 3 are stacked on the sheet pressing plate 7. A shaft 7*a* is supported by the bottom surface of the sheet feed tray 6 at the end of the sheet pressing plate 7 that is farthest from the sheet feed roller 8. The shaft 7*a* enables the end of the sheet pressing plate 7 that is closest to the sheet feed roller 8 to pivot vertically with the shaft 7*a* as a pivotal center. The sheet pressing plate 7 is biased toward the sheet feed roller 8 by a not-shown spring from its under surface. Thus, the sheet pressing plate 7 pivots downward against the biasing force of the spring by an amount proportional to the stacked quantity of sheets 3. The sheet feed roller 8 and the separation pad 9 are disposed in confrontation with each other and the separation pad 9 is pressed toward the sheet feed roller 8 by a spring 13 disposed on the back of the separation pad 9.

The feeder section 4 further includes a hand supply tray 14, a hand supply roller 15, and a separation pad 25. The hand supply tray 14 includes a tray portion 14*b* and a cover portion 14*c*. The tray portion 14*b* is provided in the front part of the main body case 2, that is, the left side of FIG. 3. The tray portion 14*b* is opened and closed in front and back directions, that is, the left and right directions in FIG. 3, with a shaft 14*a* as a fulcrum. The sheets 3 can be stacked on the tray portion 14*b* when the tray portion 14*b* is open. The cover portion 14*c* slides with respect to the tray section 14*b* and forms a part of the main body case 2 when the tray section 14*b* is closed. The hand supply roller 15 is for feeding the sheets 3 to be stacked on the tray section 14*b* of the hand supply tray 14. The separation pad 25 is for preventing double feed of the sheets 3.

The hand supply roller 15 and the separation pad 25 are disposed opposed to each other. The separation pad 25 is pressed toward the hand supply roller 15 by a spring (not shown) disposed on the back of the separation pad 25. At the time of printing, the sheets 3 stacked on the hand supply tray 14 are delivered by frictional force from the rotating hand supply roller 15 and prevented from being doubly fed by the separation pad 25, thereby being conveyed to the registration rollers 12 one by one.

A low-voltage power source 90 and a high-voltage power source 95 are provided between the image forming section 5 and sheet feed tray 6. The low-voltage power source 90 is disposed beneath a scanner unit 16 described later and the fixing device 18. The high-voltage power source 95 is disposed beneath the process cartridge 17. The high-voltage power source 95 generates a high-voltage bias that is applied to components in the process cartridge 17 to be described later. Although not shown in the drawings, a high-voltage power source circuit board is disposed in the high-voltage power source 95. The low-voltage power source 90 converts a single-phase 100-Volt power from a source external to the laser printer 1 into a voltage of 24 Volts for supply to components within the laser printer 1. Although not shown in the drawings, the low-voltage power source 90 includes a low-voltage power source circuit board for converting voltage in this manner. The low-voltage power source circuit board is disposed in the bottom section of the low-voltage power source 90. A steel plate open on the left and right encloses the low-voltage power source 90 to protect the circuit board.

A power source fan 120 is provided to the right of the low-voltage power source 90 on the portion of the main frame that is nearest the viewer of FIG. 3. The power source fan 120 is for introducing external air to cool the low-voltage power source 90, which generates a large amount of heat. Similarly, a main fan 117 is provided in the main frame on the far side from the viewer of FIG. 3, to the left of the low-voltage power source 90 for exhausting primarily air around the low-voltage power source 90 out of the laser printer 1. An ozone fan 108*b* and a sub fan 118 are also provided in the left side of the main frame, that is, at the far side of the printer 1 as viewed in FIG. 3.

Figure 4:
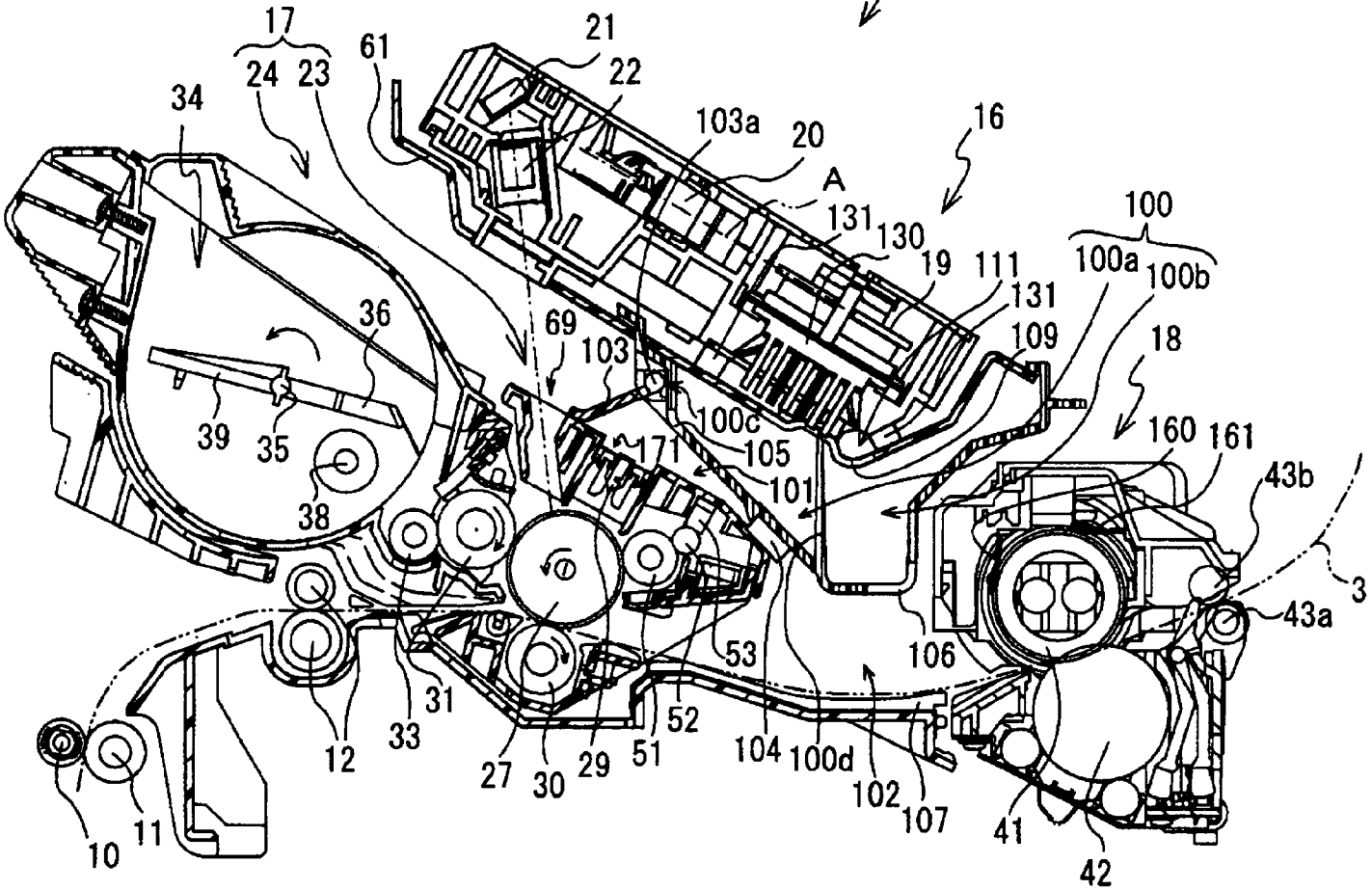
FIG. 4 is a side cross-sectional view of an image forming section in the laser printer.
Figure 5:
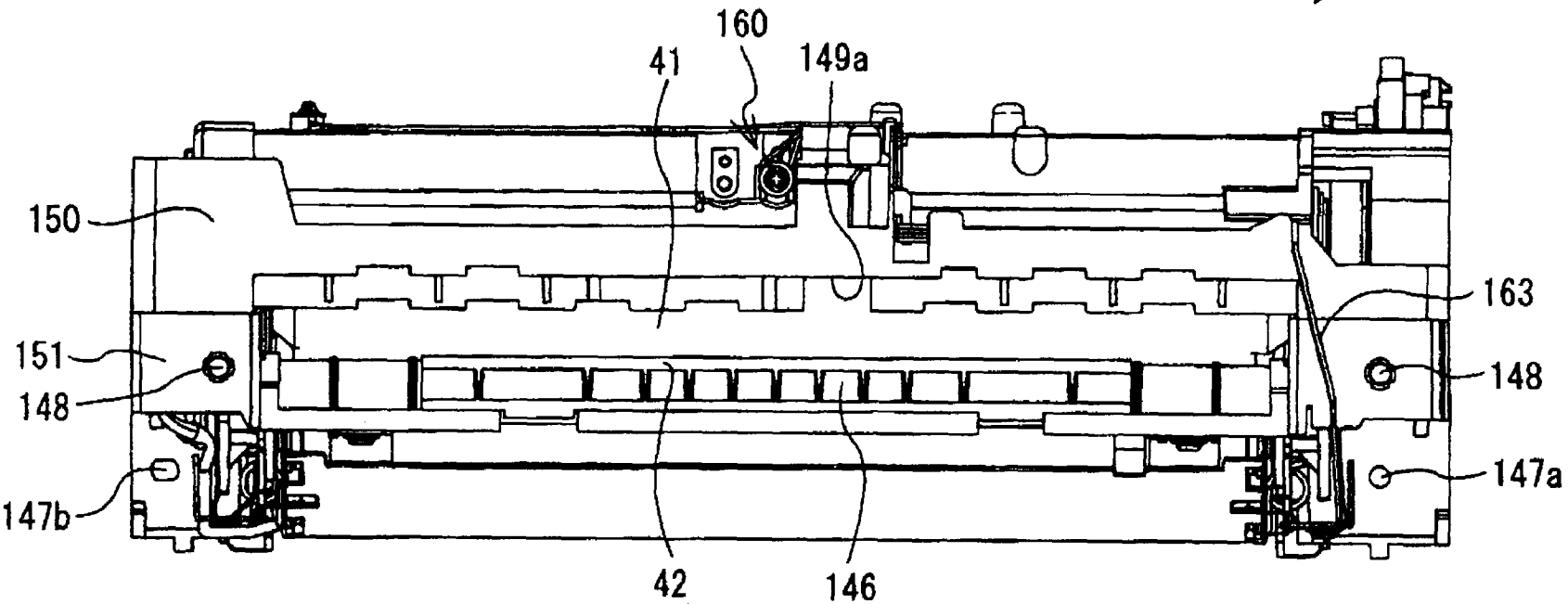
FIG. 5 is a front view of a fixing device in the image forming section.
Figure 6:
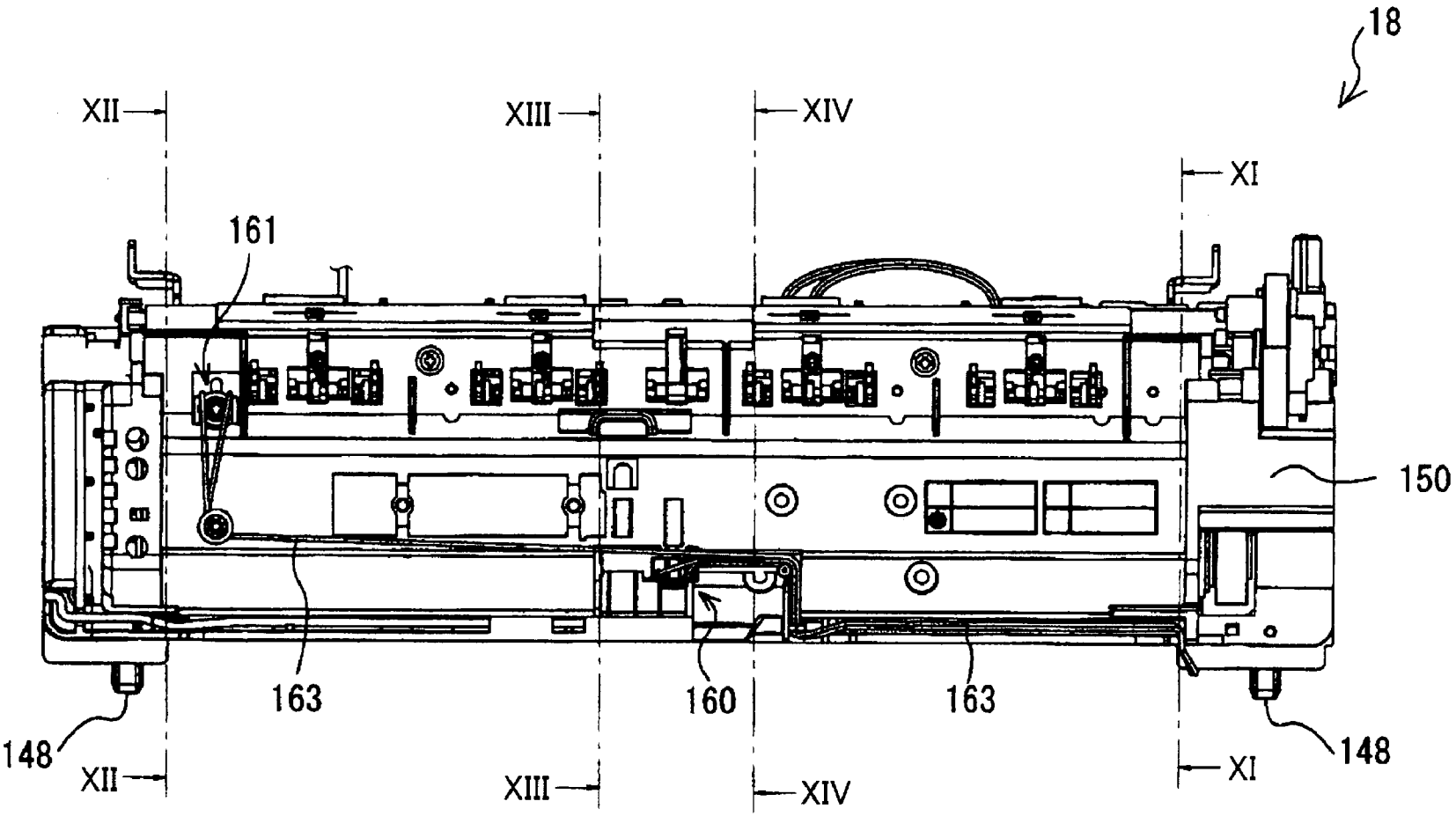
FIG. 6 is a plan view of the fixing device.
Figure 9:
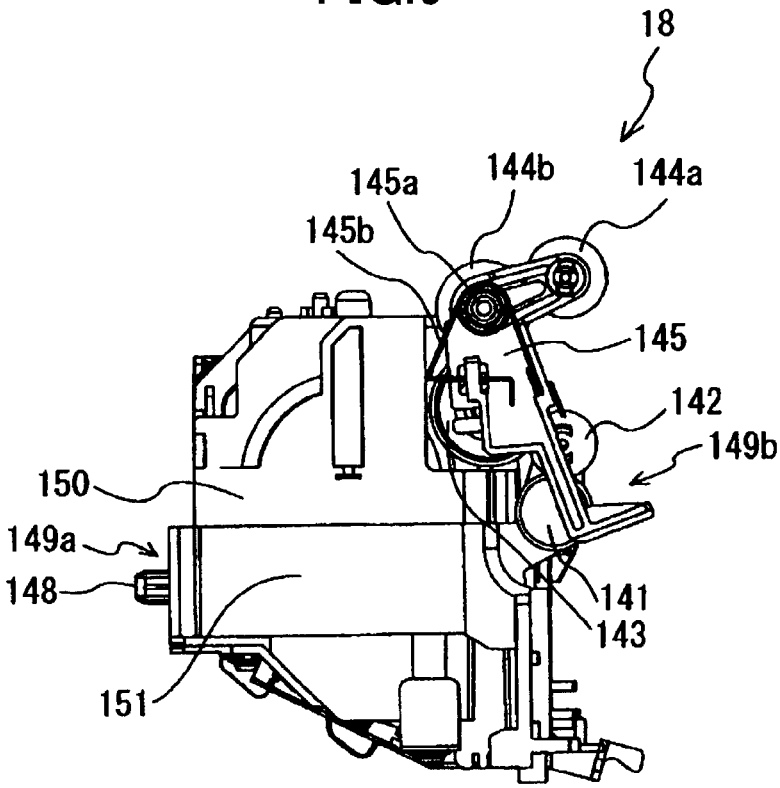
FIG. 9 is a right side view of the fixing device.

Next, configuration of the image forming section 5 will be described with reference to FIGS. 4 to 6 and 9. FIG. 4 is a sectional view of the image forming section 5 viewed from a side thereof. FIG. 5 is perspective view of the image forming section 5 disassembled into main components. FIG. 6 is a side view of the process cartridge 17. FIG. 9 is a view showing the perimeter of a shutter 103 viewed from an insertion port of the process cartridge 17. As shown in FIGS. 4 and 5, the image forming section 5 includes a scanner unit 16, the process cartridge 17, the fixing device 18, and a duct 100. The image forming section 5 is for forming an image on the sheet 3 conveyed by the feeder section 4.

The scanner unit 16 includes a laser beam emitting section (not shown), a polygon mirror 19, a heat sink 130, a fθ lens 20, a reflecting mirror 21, and a relay lens 22. The laser beam emitting section is located below the sheet delivery tray 46 in the upper part of the main body case 2 and irradiates a laser beam. The polygon mirror 19 rotates to scan the laser beam from the laser beam emitting section in a main scanning direction across the surface of a photosensitive drum 27. The heat sink 130 is for radiating heat generated by the polygon mirror 19. The fθ lens 20 is for stabilizing scanning speed of the laser beam reflected from the polygon mirror 19. The reflecting mirror 21 is for reflecting the laser beam. The relay lens 22 is for adjusting the focal position in order to focus the laser beam from the reflecting mirror 21 onto the photosensitive drum 27. With this configuration, the laser beam is irradiated from the laser beam emitting section based upon predetermined image data and passes through or is reflected by the polygon mirror 19, the fθ lens 20, the reflecting mirror 21, and the relay lens 22 in this order as indicated by an alternate long and dash lines A to expose and scan the surface of the photosensitive drum 27 of the process cartridge 17.

The process cartridge 17 includes a drum cartridge 23 and a developing cartridge 24 that is detachably mounted on the drum cartridge 23. The drum cartridge 23 includes the photosensitive drum 27, a Scorotron charger 29, a transfer roller 30, a cleaning roller 51, a secondary roller 52, and the like. The developing cartridge 24 includes a developing roller 31, a supply roller 33, a toner box 34, and the like.

The photosensitive drum 27 is arranged beside and in contact with the developing roller 31. The photosensitive drum 27 is oriented with its rotational axis aligned parallel with the rotational axis of the developing roller 31. The photosensitive drum 27 is rotatable counterclockwise as indicated by the arrow in FIG. 4. The photosensitive drum 27 includes a conductive base material and layers formed on the conductive base material. The layers include a charge generation layer and a charge transfer layer. The charge generation layer includes a binder resin in which an organic photoelectric conductor, such as azo pigments or phthalocyanine pigments, is dispersed as a charge generation material. The charge transfer layer is resin such as polycarbonate mixed with a compound such as a hydrazone compound or an arylamine compound. When the photosensitive drum 27 is exposed by a laser beam, the charge generation layer absorbs the light and generates a charge. The charge is transferred onto the surface of the photosensitive drum 27 through the charge transfer layer and counteracts the surface potential charged by the Scorotron charger 29. As a result, a potential difference is generated between regions of the photosensitive drum 27 that were exposed and regions that were not exposed by the laser light. By selectively exposing and scanning the surface of the photosensitive drum 27 with a laser beam based upon image data, an electrostatic latent image is formed on the photosensitive drum 27.

The Scorotron charger 29 is disposed above the photosensitive drum 27. The Scorotron charger 29 is separated from and out of contact with the photosensitive drum 27 by a predetermined distance. The Scorotron charger 29 generates a corona discharge from a wire made from tungsten, for example, and is for positively charging the surface of the photosensitive drum 27 to a uniform charge of positive polarity. The Scorotron charger 29 is turned ON/OFF by a charging power supply. Further, an opening 171 that communicates with the outside air is provided on the upper surface of the housing of the process cartridge 17 at a position near where the Scorotron charger 29 is provided. Ozone and other products generated during charging are discharged to the outside of the process cartridge 17 through the opening 171.

The developing roller 31 is disposed further downstream than the Scorotron charger 29 with respect to the rotation direction of the photosensitive drum 27, that is the counterclockwise direction as viewed in FIG. 4. The developing roller 31 is rotatable clockwise as indicated by an arrow in FIG. 4. The developing roller 31 includes a roller shaft made from metal coated with a roller made from a conductive rubber material. A development bias is applied to the developing roller 31 from a not-shown development bias application power supply.

The supply roller 33 is disposed beside the developing roller 31 on the opposite side from the photosensitive drum 27 across the developing roller 31. The supply roller 33 is in pressed contact with the developing roller 31. The supply roller 33 includes a roller shaft made of metal coated with a roller made of a conductive foam material and is adapted to triboelectrify toner supplied to the developing roller 31.

The toner box 34 is provided beside the supply roller 33. The inside of the toner box 34 is filled with toner to be supplied to the developing roller 31 by the supply roller 33. In this embodiment, non-magnetic, single-component toner with a positive charging nature is used as a developer. The toner is a polymeric toner obtained by copolymerizing polymeric monomers using a well-known polymerization method such as suspending polymerization. Examples polymeric monomers include styrene monomers and acrylic monomers. Styrene is an example of a styrene monomer. Examples of acrylic monomers include acrylic acid, alkyl (C1 to C4) acrylate, and alkyl (C1 to C4) methacrylate. A coloring agent such as carbon black, wax, and the like are mixed in the polymeric toner. An externally added agent such as silica is also added in order to improve fluidity. A particle diameter of the polymeric toner is approximately 6 to 10 μm.

An agitator 36 is supported by a rotation shaft 35 provided in the center of the toner box 34. The toner in the toner box 34 is agitated by counterclockwise rotation of the agitator 36 as indicated by an arrow in FIG. 4. A window 38 for determining the amount of remaining toner is provided in a sidewall of the toner box 34. A cleaner 39 supported on the rotation shaft 35 cleans the window 38.

The transfer roller 30 is disposed below the photosensitive drum 27 and downstream from the developing roller 31 with respect to the rotating direction of the photosensitive drum 27. The transfer roller 30 is rotatable clockwise as indicated by an arrow in FIG. 4. The transfer roller 30 includes a metal roller shaft coated with a roller made from an ion-conductive rubber material. During the transfer process, a transfer bias circuit unit (not shown) of the high-voltage power source 95 applies a transfer forward bias to the transfer roller 30. The transfer forward bias generates a potential difference between the surfaces of the photosensitive drum 27 and the transfer roller 30. The potential difference electrically attracts toner that electrostatically clings to the surface of the photosensitive drum 27 to the surface of the transfer roller 30.

The cleaning roller 51 is arranged beside the photosensitive drum 27 at a position downstream from the transfer roller 30 and upstream from the Scorotron charger 29 with respect to the rotating direction of photosensitive drum 27. The secondary roller 52 is located on the opposite side of the cleaning roller 51 than the photosensitive drum 27 and is contact with the cleaning roller 51. A slide contact member 53 is in abutment with the secondary roller 52. A cleaning bias circuit (not shown) of the high-voltage power source 95 applies a bias to the cleaning roller 51 and the secondary roller 52.

The photosensitive drum 27 is cleaned using the "cleanerless method." That is, after toner is transferred onto the sheet 3 from the photosensitive drum 27 by the transfer roller 30, the cleaning roller 51 electrically attracts any residual toner and paper powder that remains on the surface of the photosensitive drum 27. Then, only the paper powder is electrically attracted by the secondary roller 52 from the cleaning roller 51 and the paper powder attracted by the secondary roller 52 is caught by the slide contact member 53. At this time, the bias is switched so that the toner on the surface of the cleaning roller 51 returns to the photosensitive drum 27 and, by rotation of the photosensitive drum 27, to the developing roller 31. The developing roller 31 returns the toner to the developing cartridge 24. When the cleaning bias is switched, a transfer bias circuit (not shown) of the high-voltage power source 95 applies a transfer reverse bias to the transfer roller 30. Unlike the transfer forward bias, the transfer reverse bias generates a potential difference between the surfaces of the transfer roller 30 and photosensitive drum 27 that transfers toner on the surface of the transfer roller 30 to the surface of the photosensitive drum 27.

An exposure window 69 is opened in the upper surface of the housing of the process cartridge 17 at a position above the photosensitive drum 27. The laser beam from the scanner unit 16 passes through the exposure window 69 directly onto the photosensitive drum 27. The exposure window 69 is located closer to the toner box 34 than is the opening 171 of the Scorotron charger 29 and brings the photosensitive drum 27 into communication with the outside of the process cartridge 17.

The duct 100 exhausts air sucked by the fans **108*b* and 117 to the outside of the main body case 2. The duct 100 is a tubular exhaust passage with a V shape in a side view. The duct 100 extends along the entire length of the process cartridge 17 in a width direction of the process cartridge 17. The width direction of the process cartridge 17 is the direction perpendicular to the direction in which the process cartridge 17 is inserted into the printer 1. The inside of the duct 100 is divided into two chambers by a vertically-extending partition wall 100*d* that extends along the entire length of the duct 100 in the width direction of the process cartridge 17. One of the chambers is a duct 100*a* for exhausting a product such as ozone mainly generated by the Scorotron charger 29. The other chamber is a duct 100*b* for exhausting air containing heat mainly generated by the fixing device 18**.

When the process cartridge 17 is inserted in the main body case 2, the space above the housing of the process cartridge 17 and in the vicinity of the opening 171 is partitioned into an exhaust chamber 101 by the shutter 103, a wall surface of the lower part of the duct 100*a*, a partitioning member 104 composed of an elastic member such as rubber or sponge, a left side surface and a right side surface which are left and right side surfaces of the cartridge receiving section 57. The exhaust chamber 101 is filled with ozone generated by the Scorotron charger 29. An opening part 105 is formed in the lower surface of the duct 100*a* that faces the Scorotron charger 29. Air containing the ozone is sucked from the exhaust chamber 101, through the opening part 105, and exhausted to the duct 100*a*.

Note that the partitioning member 104 is provided on the lower surface of the duct 100*a* where the end of the process cartridge 17 abuts when the process cartridge 17 is inserted. The partitioning member 104 extends in the width direction of the process cartridge 17 across the entire length of the duct 100. The partitioning member 104 also functions as a cushioning material for absorbing shock when the process cartridge 17 is inserted.

As shown in FIG. 4, the shutter 103 is a plate-shaped member elongated in the width direction of the process cartridge 17. The shutter 103 has a length that is substantially the same as the width of the process cartridge 17. Shafts 103*a* are provided at one short-wise edge of the shutter 103 and supported by supporting portions 100*c* on the lower surface of the duct 100*a*. The shutter 103 is oriented with the shafts 103*a* facing downstream and a free end side facing upstream with respect to the inserting direction of the process cartridge 17. The supporting portions 100*c* support the shutter 103 such that the free end side thereof is movable vertically. When the shutter 103 is closed, the free end pivots into contact with the process cartridge 17 at a position between the opening 171 of the Scorotron charger 29 and the exposure window 69. Further, the shutter 103 moves in association with opening and closing of the upper surface cover 54 by a not-shown link mechanism, whereby the shutter 103 is opened and closed.

As shown in FIGS. 4 and 5, an opening part 106 is also provided on the lower surface of the duct 100*b*. An exhaust chamber 102 is defined by the front wall, with respect to the inserting direction, of the inserted process cartridge 17, the lower surface of the duct 100*b*, the fixing device 18, and a charge removing plate 107. Air in the exhaust chamber 102 is exhausted from the opening part 106. Note that the charge removing plate 107 is provided between the process cartridge 17 and the fixing device 18 on the conveying path of the sheet 3 so as to remove charges from sheets 3 that are charged as the sheets 3 pass through the process cartridge 17 during printing. The charge removing plate 107 functions as a sheet guide and is shaped with a plurality of grooves that extend in the conveying direction of the sheet 3.

An opening part 109 is formed in the wall surface of the scanner unit 16 where the heat sink 130 is opposed to the upper surface 61 of the duct 100. The opening part 109 extends from one side to the other of the partition wall 100*d* and brings the scanner unit 16 into fluid communicate with both the ducts 100*a* and 100*b*. The heat sink 130 is exposed to a gap between the scanner unit 16 and the upper surface 61 of the duct 100 through an exposure port opened in the lower wall of the scanner unit 16. A sponge 131 is provided to cover the exposed heat sink 130 and isolate the gap part from other spaces. An exhaust chamber 111 is formed in the area surrounded by the sponge 131.

As shown in FIGS. 4 and 5, the fixing device 18 is disposed downstream from the process cartridge 17 with respect to the direction of sheet transport. The fixing device 18 includes a heating roller 41, a pressing roller 42 for pressing the heating roller 41, and a pair of conveying rollers 43*a* and 43*b*. The conveying rollers 43*a* and 43*b* are provided downstream from the heating roller 41 and the pressing roller 42. The heating roller 41 includes a metal tube and a halogen lamp for heating inside the metal tube. While the sheet 3 from the process cartridge 17 passes between the heating roller 41 and the pressing roller 42, the heating roller 41 pressurizes and heats toner that was transferred onto the sheet 3 in the process cartridge 17, thereby fixing the toner onto the sheet 3. Afterward, the sheet 3 is transported to the sheet delivery path 44 by the conveying rollers 43*a* and 43*b*.

Figure 7:
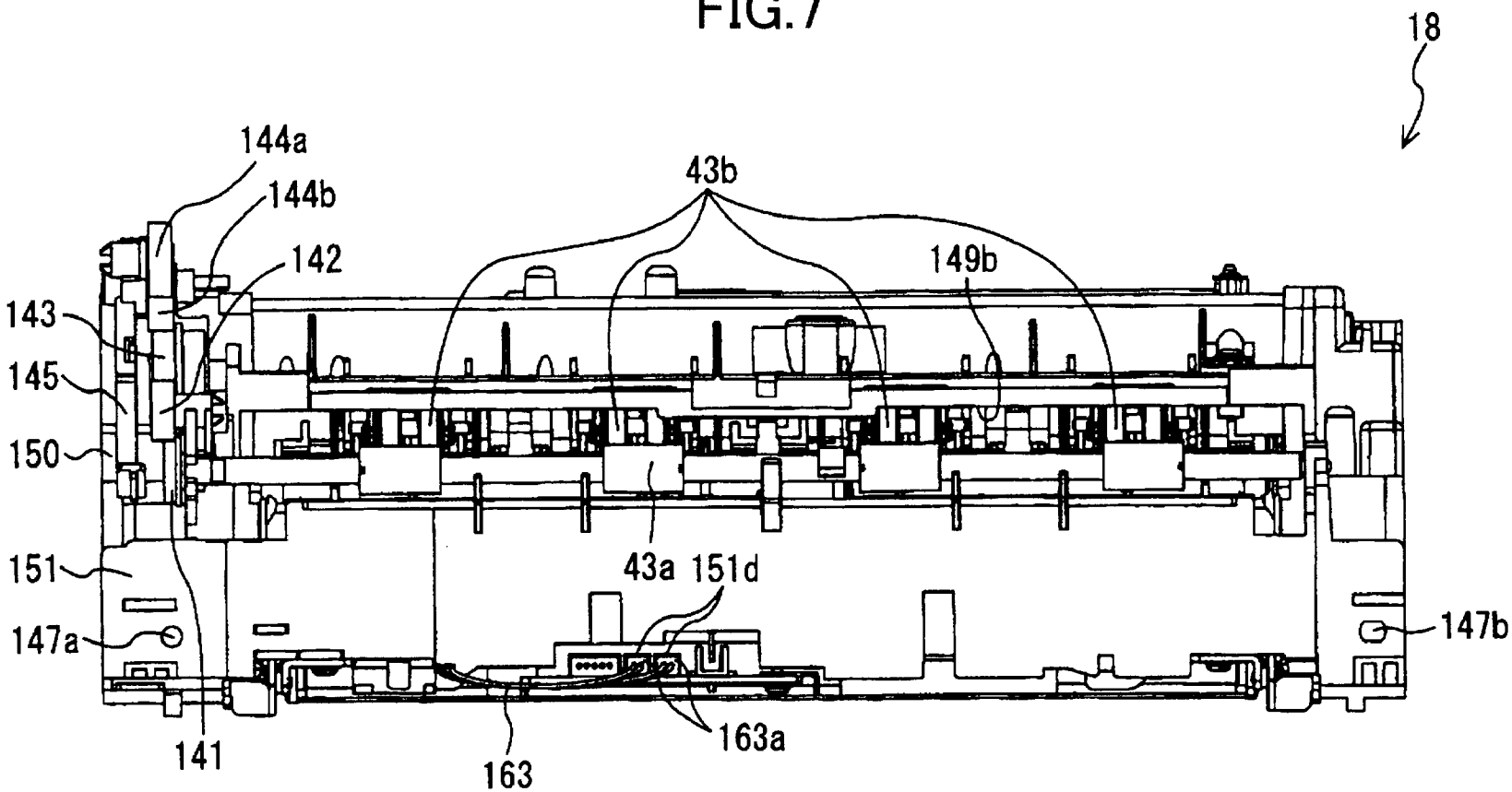
FIG. 7 is a back view of the fixing device.
Figure 13:
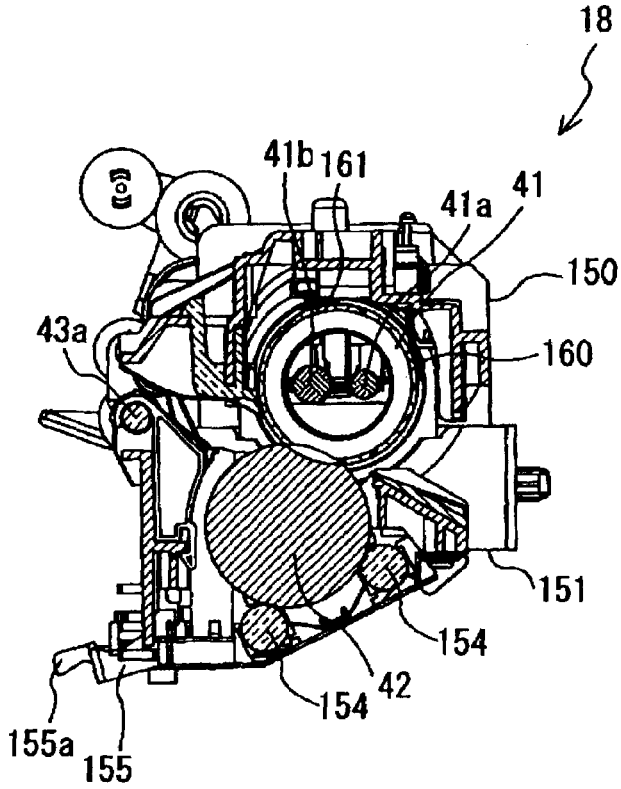
FIG. 13 is a cross-sectional view of the fixing device taken along the dotted line XIII—XIII in FIG. 6 in the direction indicated by the arrows.

As shown in FIG. 5, the fixing device 18 includes a chassis with a substantially rectangular parallelepiped shape that extends left to right. A top frame 150 and a bottom frame 151 formed of heat-resistant resin are fitted together to form the chassis. Elongated openings 149*a*, 149*b* are formed in the front and rear surfaces, respectively, of the chassis where the top frame 150 and bottom frame 151 come together. The elongated opening 149*a* is formed widthwise in the front surface to enable sheets 3 to enter the fixing device 18. As shown in FIG. 7, the elongated opening 149*b* is formed in the rear surface and enables sheets 3 to be discharged from the fixing device 18. As shown in FIG. 13, the heating roller 41 and the pressing roller 42 are juxtaposed in the chassis with their axes of rotation extending left-to-right.

Figure 10:
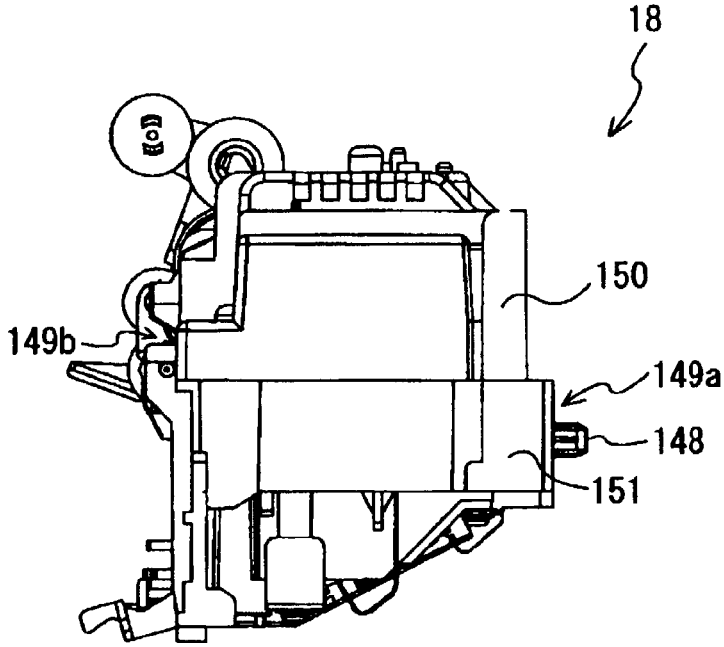
FIG. 10 is a left side view of the fixing device.

As shown in FIGS. 5, 9, and 10, protrusions 148 are formed on the front surface of the bottom frame 151 at both ends. When the fixing device 18 is being inserted into the laser printer 1, the position of the fixing device 18 is determined by inserting the protrusions 148 into fitting holes formed in the main frame (not shown) of the printer 1. As shown in FIGS. 5 and 7, screw holes 147*a* and 147*b* are formed in the left and right ends at the bottom of the bottom frame 151 and penetrate through the bottom frame 151 from front-to-back. The fixing device 18 is fixed to the main frame by inserting screws (not shown) into the screw holes 147*a* and 147*b*.

As shown in FIG. 5, a conveying roller 146 with an axis extending lengthwise in the fixing device 18 is disposed near the opening 149*a* in the front surface side of the bottom frame 151. The conveying roller 146 functions as a guide for conveying the sheets 3 into the fixing device 18. As shown in FIG. 7, a pair of top and bottom conveying rollers 43*a* and 43*b* is provided near the opening 149*b* in the back surface of the bottom frame 151 for guiding the sheets 3 being discharged from the fixing device 18 onto the sheet delivery path 44. The axes of the conveying rollers 43*a* and 43*b* extend left-to-right in the fixing device 18. The conveying roller 43*a* is divided into four sections of rubber rollers on a steel shaft. The upper conveying roller 43*b* includes four resinous rollers positioned to contact each of the four rubber rollers in the bottom conveying roller 43*a*.

As shown in FIG. 7, a gear 141 connected to the shaft of the conveying roller 43*a* is disposed on the right side of the fixing device 18 near the back surface. Gears 142 and 143 are engaged with the gear 141. Gear teeth provided around the circumference of the heating roller 41 engage with the gear 143. The conveying roller 43*a* follows rotation of the heating roller 41 when the heating roller 41 is driven to rotate by a driving force transferred from an external source. As shown in FIG. 9, an L-shaped arm 145 includes two side plates that extend orthogonal to one another and away from a shaft 145*a* about which the L-shaped arm 145 rotates. The rotational axes of the gears 142 and 143 are fixed one after another in one side plate of the L-shaped arm 145 on the far side from the shaft 145*a*. A spring 145*b* is wrapped around the shaft 145*a* for applying an urging force to the L-shaped arm 145. When the fixing device 18 is not mounted in the laser printer 1, the urging force of the spring 145*b* rotates the L-shaped arm 145 to pivot the gear 143 away from the heating roller 41 (a counterclockwise rotation in FIG. 7), thereby separating the gear 142 from the gear 141 of the conveying roller 43*a* and the gear 143 from the gear teeth at the circumference of the heating roller 41. Hence, the conveying roller 43*a* can be freely rotated when the fixing device 18 is removed from the laser printer 1 for maintenance purposes.

The other side plate L-shaped arm 145 extends orthogonally to an imaginary line that extends between the shaft 145*a* and the gear 142. A pulley 144*a* is supported on the free end of the other side plate. The pulley 144*a* contacts the main frame when the fixing device 18 is mounted in the laser printer 1. When the pulley 144*a* contacts the mainframe, the pulley 144*a* pivots downward so that the L-shaped arm 145 rotates in the clockwise direction of FIG. 9. Accordingly, the gears 142 and 143 engage with the gear 141 of the conveying roller 43*a* and the external gear teeth of the heating roller 41. Another pulley 144*b* is provided with the shaft 145*a* as its center of rotation. Because the fixing device 18 moves from right to left as viewed in FIG. 9 when inserted into the printer 1, the pulley 144*b* contacts the main frame before the pulley 144*a* when the fixing device 18 is mounted in the laser printer 1 so that the L-shaped arm 145 rotates smoothly.

Temperature sensors 160 and 161 shown in FIG. 6 are disposed in the fixing device 18 in contact with the periphery of the heating roller 41 in order to measure the surface temperature of the heating roller 41. As shown in FIGS. 5 and 6, the temperature sensor 160 is fixed by a screw to a position near the front surface in the top center of the fixing device 18. As shown in FIG. 6, the temperature sensor 161 is similarly fixed by a screw to a position on the back surface and in the top left of the fixing device 18. A more detailed description of the temperature sensors 160 and 161 will be provided below.

Figure 14:
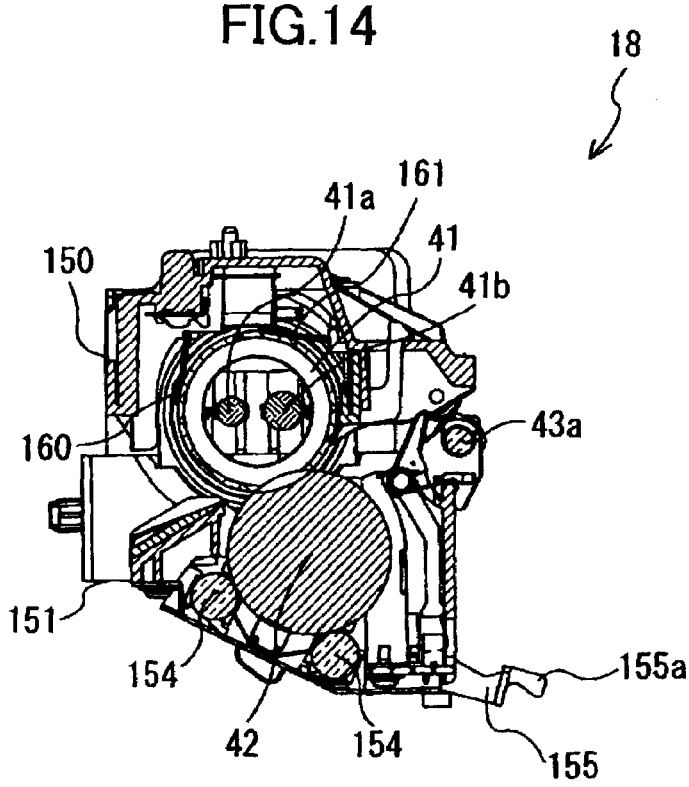
FIG. 14 is a cross-sectional view of the fixing device taken along the dotted line XIV—XIV in FIG. 6 in the direction indicated by the arrows.

As shown in FIGS. 13 and 14, the top frame 150 and bottom frame 151 of the fixing device 18 accommodate the heating roller 41 and pressing roller 42. The heating roller 41 is formed by coating a hollow aluminum roller with a fluorocarbon resin and sintering the assembly. The shaft of the heating roller 41 is supported on both ends of the top frame 150. Halogen lamps 41*a* and 41*b* are provided in and extend along the length of the heating roller 41. A tungsten filament is provided in the center portion of the halogen lamp 41*a* to primarily heat the center of the heating roller 41. Tungsten filaments are provided on both ends of the halogen lamp 41*b* in order that the halogen lamp 41*b* primarily heats the left and right ends of the heating roller 41. The entire heating roller 41 is evenly heated when a voltage is applied to both the halogen lamps 41*a* and 41*b*. By disposing the halogen lamps 41*a* and 41*b* having different heating positions in the heating roller 41, it is possible to maintain an even temperature across the heating roller 41 while increasing the rate at which the temperature of the heating roller 41 rises.

Figure 11:
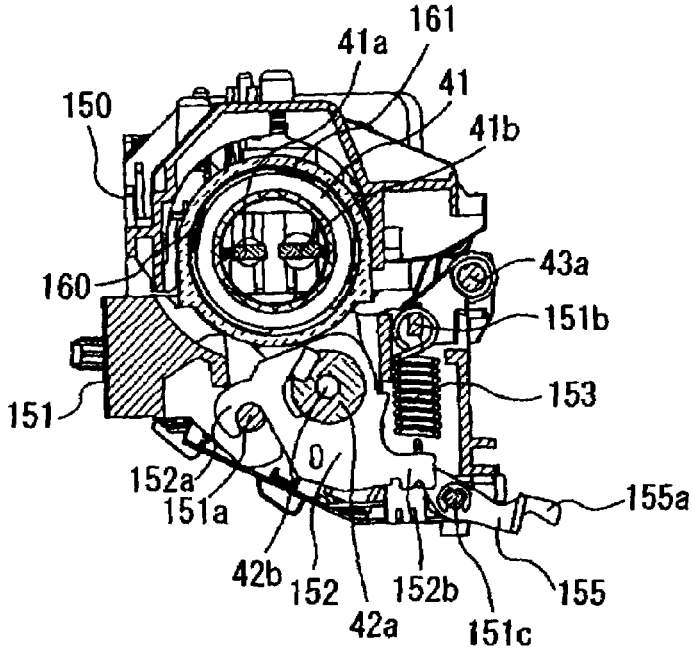
FIG. 11 is a cross-sectional view of the fixing device taken along the dotted line XI—XI in FIG. 6 in the direction indicated by the arrows.
Figure 12:
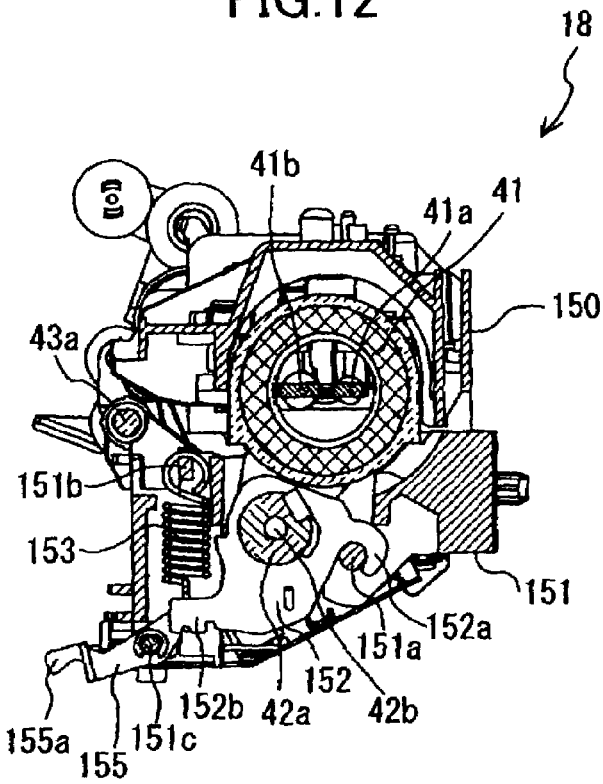
FIG. 12 is a cross-sectional view of the fixing device taken along the dotted line XII—XII in FIG. 6 in the direction indicated by the arrows.

The pressing roller 42 includes a silicon rubber shaft having low hardness that is covered by a tube formed of a fluorocarbon resin. As shown in FIGS. 11 and 12, a support shaft 42*b* and a ball bearing 42*a* are provided on both ends of the pressing roller 42, enabling the pressing roller 42 to rotate. The ball bearings 42*a* are supported in shaft support plates 152. A hook-shaped hook 152*a* protrudes from the edge of the shaft support plate 152 and engages with a support shaft 151*a* protruding from the bottom frame 151 at a position below the heating roller 41. The shaft support plate 152 can be driven to pivot about the support shaft 151*a* within the imaginary plane occupied by the shaft support plate 152. An operating portion 152*b* protrudes from the shaft support plate 152 on the opposite side of the hook 152*a*. One end of a spring 153 is attached to the operating portion 152*b*. The other end of the spring 153 is attached to an engaging part 151*b* provided on the back part of the bottom frame 151. The spring 153 urges the operating portion 152*b* upward. As a result, the portion of the shaft support plate 152 that supports the pressing roller 42 between the hook 152*a* and operating portion 152*b* is urged upward, pressing the pressing roller 42 against the heating roller 41. A lever 155 is disposed in contact with the operating portion 152*b* of the shaft support plate 152. The lever 155 rotates in the same plane as the shaft support plate 152 about a shaft 151*c* provided in the bottom frame 151 near the operating portion 152*b*. When a paper jam occurs in the fixing device 18, for example, the user presses an operating portion 155*a* of the lever 155 upward to force the operating portion 152*b* downward against the resisting force to the spring 153. Accordingly, the shaft support plate 152 rotates in the clockwise direction in FIG. 11, separating the pressing roller 42 from the heating roller 41 and enabling the user to remove the paper jammed between the rollers. Further, as shown in FIGS. 13 and 14, two cleaning rollers 154 are provided along the bottom surface of the bottom frame 151 below the pressing roller 42 in pressing contact with the pressing roller 42. The cleaning rollers 154 clean the pressing roller 42 while rotating along with the pressing roller 42.

Figure 15:
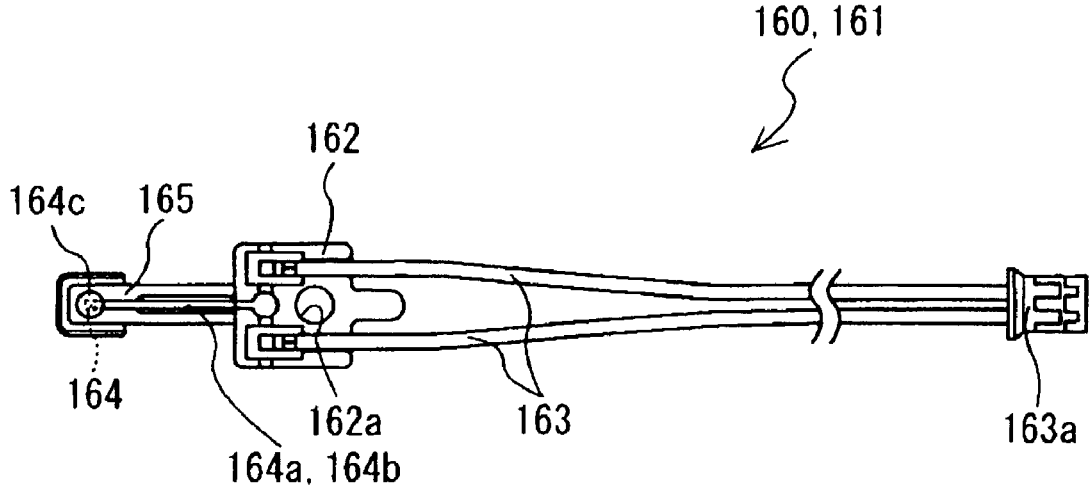
FIG. 15 is a plan view of a temperature sensor in the fixing device.

As shown in FIG. 15, both of the temperature sensors 160 and 161 have the same shape, so the following explanation will be provided for the temperature sensor 160 only as a representative example. The temperature sensor 160 has an elongated plate shape and includes a contact plate 165, a base 162, a temperature detecting element 164, and lead wires 163. The contact plate 165 contacts the outer periphery of the heating roller 41 at one end and is fixed to the base 162 at the other. The temperature detecting element 164 is fixed on upper surface of the contact plate 165. The lead wires 163 are for applying a voltage to the temperature detecting element 164.

Figure 16:
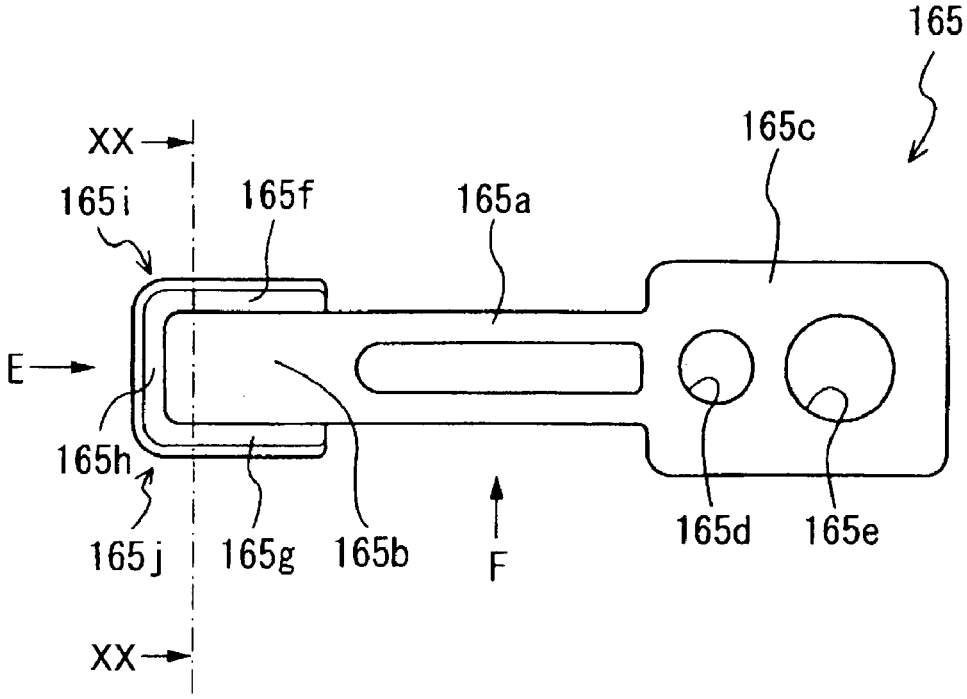
FIG. 16 is a plan view of a contact plate in the temperature sensor.
Figure 17:
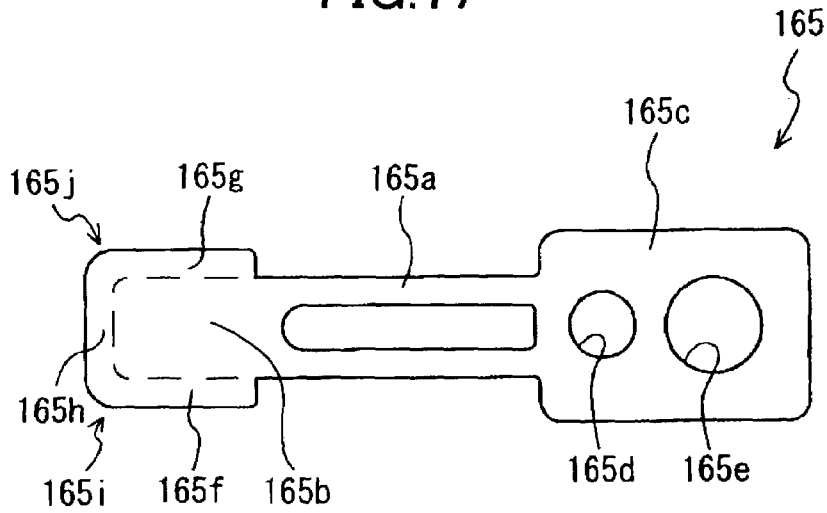
FIG. 17 is a bottom view of the contact plate.

The contact plate 165 is a stainless steel plate having a substantially rectangular plate shape in the plan views of FIGS. 16 and 17. The contact plate 165 includes a contact section 165*b*, an attachment section 165*c*, a connecting section 165*a*, side edges 165*f*, 165*g*, and 165*h*, and corner sections 165*i*, 165*j*, all connected integrally together. The contact section 165*b* is for contacting the heating roller 41. The contact section 165*b* and the attachment section 165*c* are provided on opposite ends of the connecting section 165*a*. The connecting section 165*a* connects the contact section 165*b* and the attachment section 165*c* and is formed with a slot-like opening formed lengthwise in the center thereof.

The attachment section 165*c* is formed wider than the contact section 165*b* and is for fixing the contact plate 165 to the base 162. The attachment section 165*c* is formed with a positioning hole 165*d* and a screw hole 165*e*. The positioning hole 165*d* is for positioning the attachment section 165*c* when fixing the contact plate 165 to the base 162 as shown in FIG. 15. The screw hole 165*e* is for inserting a screw to fix the base 162 to the top frame 150 as shown in FIGS. 5 and 6.

The contact section 165*b* includes a lower surface and an upper surface on opposite surfaces thereof. The contact section 165*b* contacts the thermal roller 41 at its lower surface. The lower surface of the contact section 165*b* can be alternatively referred to as the surface forms the outer side of the bent portions of the side edges 165*f*, 165*g*, and 165*h*. The temperature detecting element 164 is attached to the upper surface of the contact section 165*b*. The thickness of the contact section 165*b* is the dimension of the contact section 165*b* from the lower surface to the upper surface. Hereinafter "thickness direction" will be used to refer to the direction from the lower surface to the upper surface of the contact section 165*b*.

Figure 18:
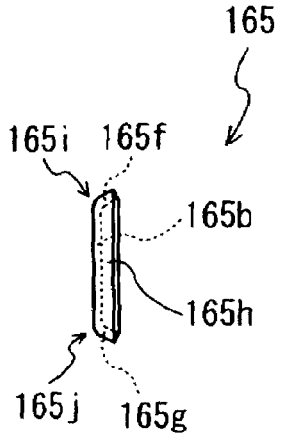
FIG. 18 is a side view of the contact plate in the direction indicated by an arrow E in FIG. 16.
Figure 19:
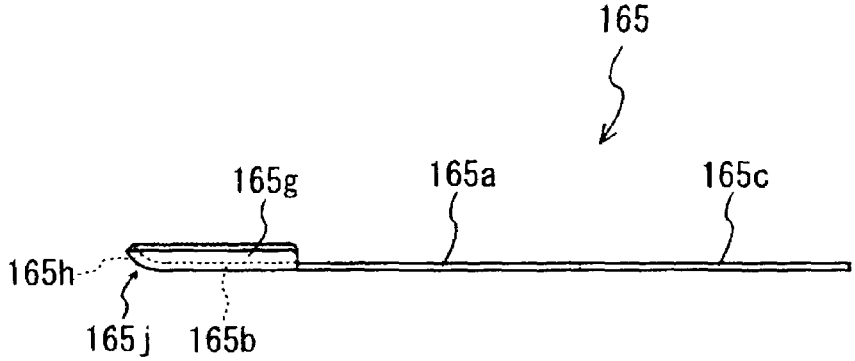
FIG. 19 is a side view of the contact plate in the direction indicated by an arrow F in FIG. 16.
Figure 20:
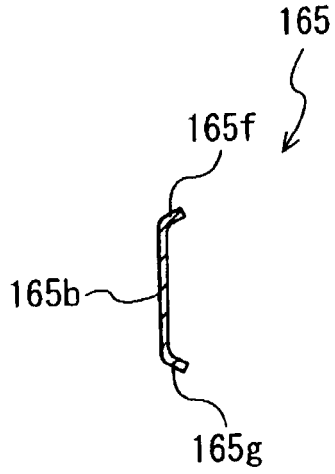
FIG. 20 is a cross-sectional view of the contact plate taken along the dotted line XX—XX in FIG. 16 in the direction indicated by the arrows.

The side edge 165*h* is integrally connected to the lengthwise end of the contact section 165*b*. The side edges 165*f*, 165*g* are integrally connected to widthwise sides of the contact section 165*b*. The side edges 165*f*, 165*g*, and 165*h* slant upward away from the lower surface of the contact section 165*b* in the thickness direction of the contact section 165*b*, that is, toward the viewer in FIG. 16. The edge at the free end of each of the side edges 165*f*, 165*g*, and 165*h* follows parallel to corresponding edge of the contact section 165*b*. The corner section 165*i* connects the side edge 165*f* and side edge 165*h* together and the corner section 165*j* connects the side edge 165*g* and side edge 165*h* together. With this configuration, the side edge 165*f*, the corner section 165*i*, the side edge 165*h*, the corner section 165*j*, and the side edge 165*g* form a continuous wall that wraps around the contact section 165*b* on all sides but the side that is integrally connected to the connecting section 165*a*. The lower surface of the continuous wall forms an acute angle with the lower surface of the contact section 165*b*. The acute angle is approximately 45 degrees in the preferred embodiment as can be seen in FIGS. 18 to 20, for example.

Regions of the contact plate 165 where the side edges 165*f*, 165*g*, and 165*h* connect to the contact section 165*b* are curved at the outer surface of these regions. As a result, the contact plate 165 only contacts the heating roller 41 with smooth, curved surfaces, so that the contact plate 165 will not damage the heating roller 41. Further, the outer surfaces of the corner sections 165*i* and 165*j* are formed as spherical surfaces. As a result, surfaces at which the side edges 165*f*, 165*g*, and 165*h* meet are connected smoothly. Also, because the corner sections 165*i* and 165*j* connect the side edges 165*f*, 165*g*, and 165*h* integrally together, there are no places where toner can accumulate and form a clump.

The contact plate 165 is formed so that the upper edge of the continuous wall configured by the side edges 165*f*, 165*g*, and 165*h* and the corner sections 165*i* and 165*j* is separated, in the thickness direction, from the portion of the lower surface that contacts the heating roller 41 by a distance that is two times or greater than the thickness of the contact section 165*b*. The contact plate 165 is coated with a corrosion-resistant coating such as fluorocarbon resin on the lower surface from the contact section 165*b* to a portion of the connecting section 165*a*, in order to form a smooth surface.

Figure 21:
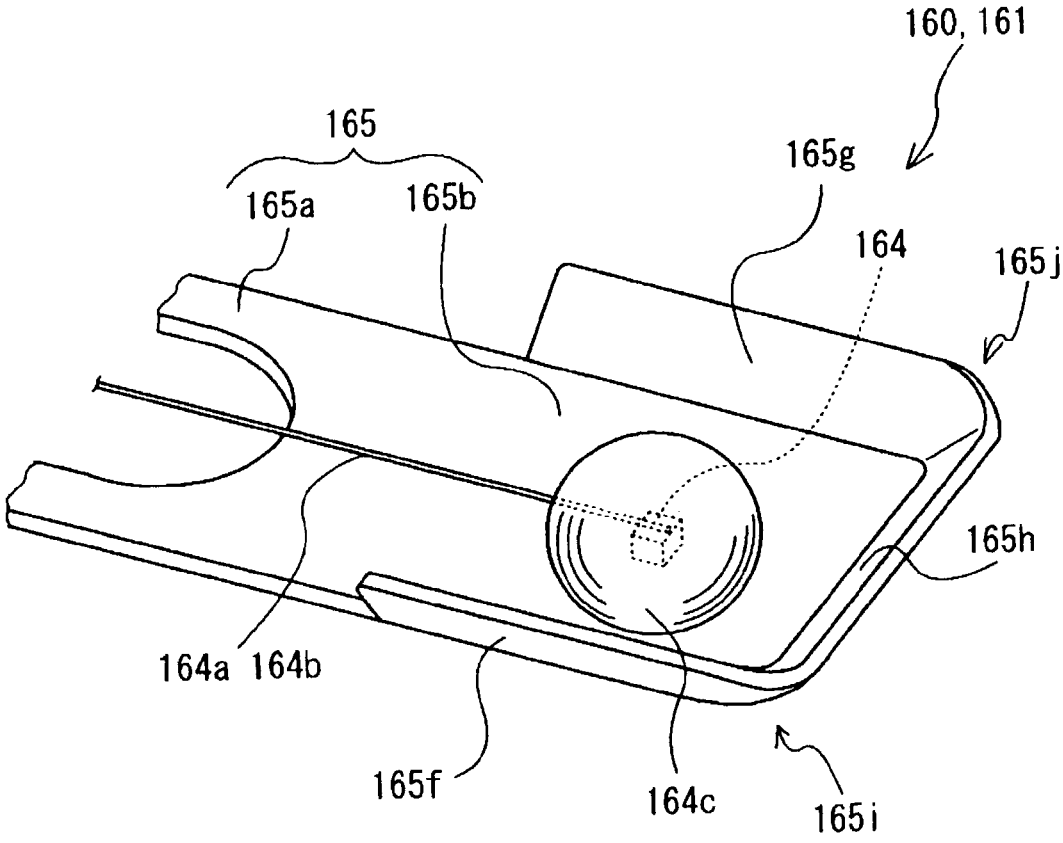
FIG. 21 is an enlarged perspective view showing the end portion of the temperature sensor.

As shown in FIGS. 15 and 21, the temperature detecting element 164 is fixed to the center of the upper surface of the contact section 165*b*. The temperature detecting element 164 is a multilayer chip-type temperature sensor formed from a semiconductor ceramic substrate interposed between two terminals. The semiconductor ceramic substrate is made from a metal oxide of iron, manganese, cobalt, or nickel for example. The resistance value in the temperature detecting element 164 decreases logarithmically with increase in temperature. The temperature detecting element 164 is insulated from the surroundings and fixed to the surface of the contact section 165*b* by an adhesive 164*c*. The two terminals of the temperature detecting element 164 are connected to conducting wires 164*a* and 164*b*.

Figure 8:
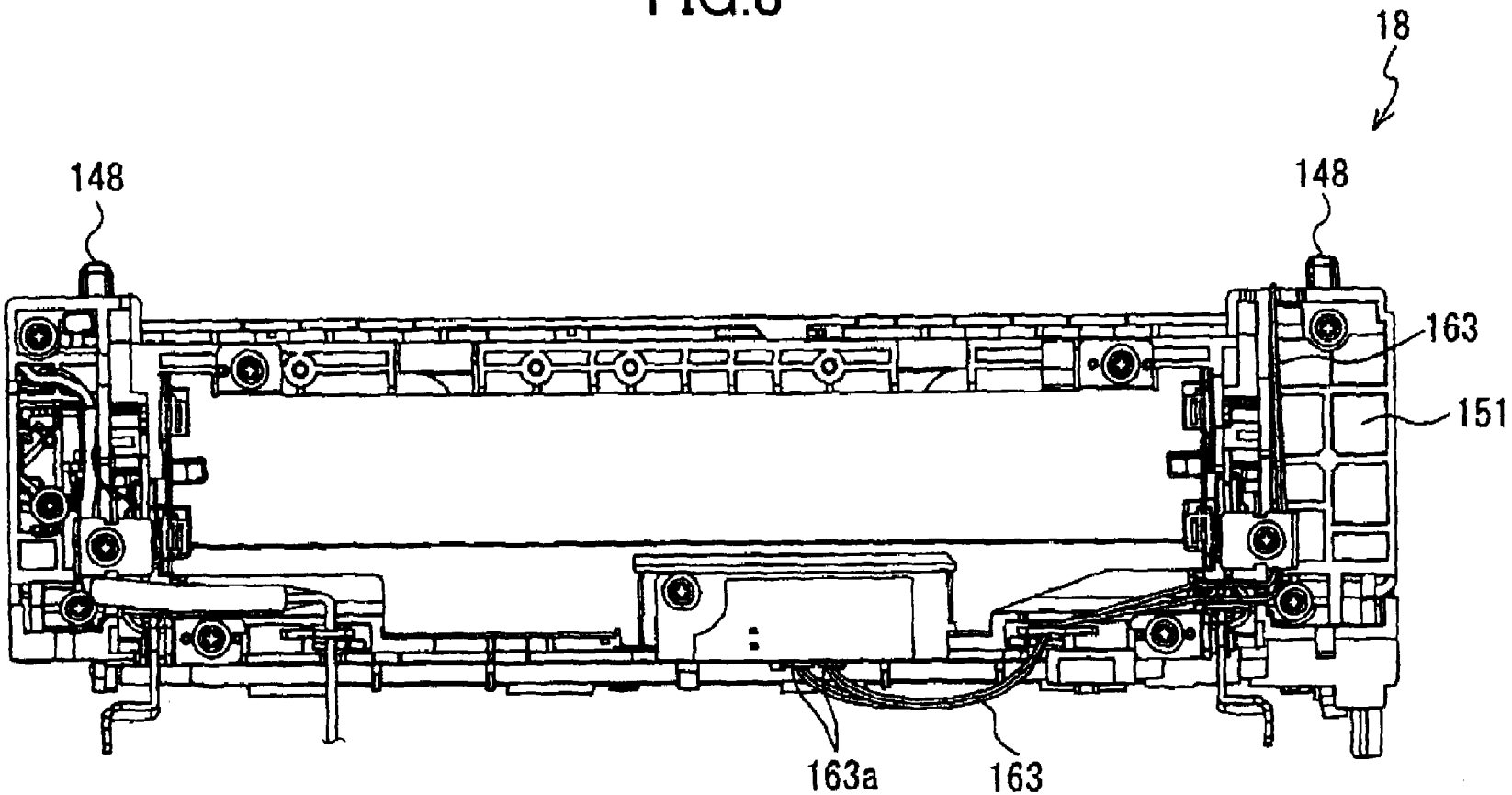
FIG. 8 is a bottom view of the fixing device.

The base 162 is shown in FIG. 15. The base 162 is formed in a cubic shape from resin covering the attachment section 165*c* of the contact plate 165. A screw hole 162*a* is formed in the base 162 for fixing the base 162 to the main frame (not shown). The screw hole 162*a* penetrates through the base 162 in the thickness direction at a position aligned with the screw hole 165*e* of the attachment section 165*c*. The two lead wires 163 are fixed at one end to the base 162 at either side of the screw hole 162*a* and at the other end to a connector 163*a*. One of the lead wires 163 is connected to the conducting wire 164*a*, which is connected to the temperature detecting element 164, and the other lead wires 163 is connected to the conducting wire 164*b*. FIGS. 5 and 6 show the temperature sensors 160 and 161 fixed by screws in the fixing device 18 through the bases 162. FIGS. 5, 6, and 8 show the lead wires 163 running along the outer wall of the top frame 150 and bottom frame 151. FIG. 7 shows the connector 163*a* engaged in a connector box 151*d* provided in the lower center of the bottom frame 151.

Figure 22:
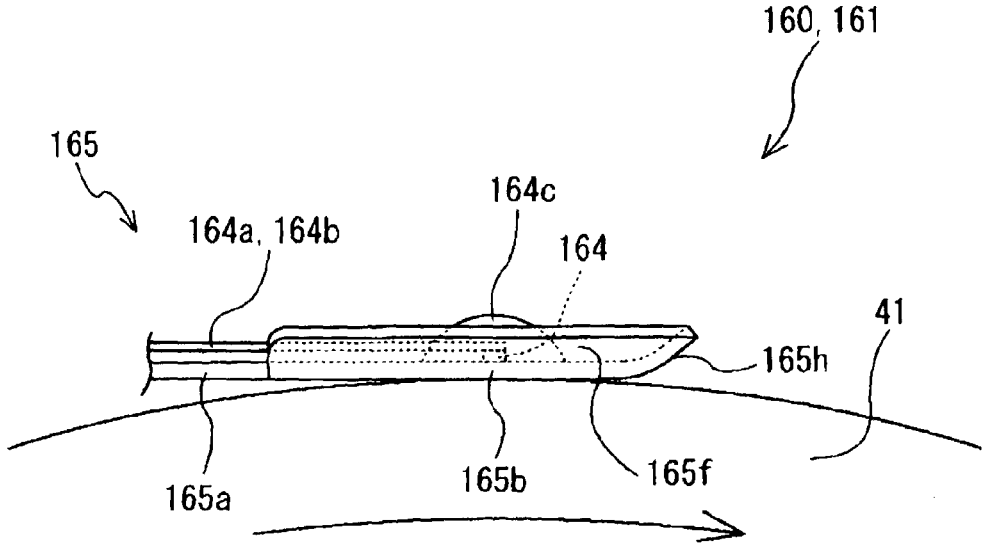
FIG. 22 is an enlarged side view showing the contact area between the end portion of the temperature sensor and a heating roller in the fixing device.

As shown in FIG. 6, the temperature sensors 160 and 161 are fixed on the top frame 150. As shown in FIG. 22, the temperature sensors 160 and 161 are supported with the contact section 165*b* of the contact plate 165 in contact with the outer surface of the heating roller 41 and are oriented with the connecting section 165*a* upstream from the contact section 165*b* with respect to rotation direction of the heating roller 41 indicated by an arrow in FIG. 22. Said differently, the surface of the heating roller 41 moves counterclockwise as viewed in FIG. 11, that is, in the direction from the base 162 to the end of the contact plate 165.

As mentioned previously, each temperature sensor 160 and 161 contacts the heating roller 41 with the lower surface of the contact section 165*b*. The temperature detecting element 164 is fixed on the upper surface of the contact section 165*b*, that is, on the opposite side of the contact section 165*b* than the side that contacts the heating roller 41. Therefore, the lower surface of the contact section 165*b*, which contacts the object of detection, can be formed as a smooth surface.

Also, the temperature sensors 160 and 161 are supported with the temperature detecting element 164 aligned at the actual position of contact. Further, the lower surface of the side edge 165*h* curves away from the surface of the heating roller 41 starting from a position that is farther downstream, with respect to the rotating direction of the heating roller 41, than is the position of contact with the heating roller 41. As a result, the lower surface of the side edge 165*h* slants upward from the surface of the heating roller 41 so that the edge of the free end of the side edge 165*h* is separated by a prescribed distance from the surface of the heating roller 41. The prescribed distance is two times the thickness of the contact section 165*b* in the present embodiment. Because the upwardly-curving side edge 165*h* is located downstream with respect to rotation direction of the heating roller 41, no edge that can lead to the accumulation of toner is located downstream from the contact point between the temperature detection element 164 and the heating roller 41. Therefore, clumps of toner can be prevented from becoming fixed on the sheets 3.

Additionally, because the lower surface of the contact plate 165 curves away from the surface of the heating roller 41 from a position that is separated from the contact position between the heating roller 41 and contact plate 165, it is possible to prevent an abrupt separation between opposing surfaces of the contact plate 165 and the heating roller 41 to enable smooth movement of toner and other foreign matter between these surfaces.

Also, because the areas of the contact plate 165 where the side edges 165*f*, 165*g*, and 165*h* connect to the contact section 165*b* and the outer surfaces of the corner section 165*i* and 165*j* are formed as curved surfaces, the lower surface of the contact plate 165 is curved from the contact section 165*b* to the side edge 165*h*, the contact plate 165 has no corner portion that can activate build up of toner.

The temperature sensors 160 and 161 are supported in contact within a "fixing range" in the left-to-right direction of the heating roller 41. The fixing range of the heating roller 41 is the portion of the fixing device 18 that contacts printed portions of sheets 3 as the sheets 3 pass between the heating roller 41 and the pressing roller 42 and corresponds to the printable region where the process cartridge 17 transfers toner images onto sheets 3 that pass between the photosensitive drum 27 and the transfer roller 30. The temperature sensor 160 is supported in contact with a surface portion of the heating roller 41 that is heated mainly by the halogen lamp 41*a*. The temperature sensor 161 is supported in contact with a surface portion of the heating roller 41 that is heated mainly by the halogen lamp 41*b*.

Operations of the laser printer 1 during printing will be described with reference to FIGS. 3 and 4. The sheet 3 located at the top among the sheets stacked on the sheet pressing plate 7 of the sheet feed tray 6 is pressed toward the sheet feed roller 8 by a not-shown spring from the back of the sheet pressing plate 7. When printing is started, the sheet 3 is fed by frictional force between the sheet 3 and the rotating sheet feed roller 8 to a position between the sheet feed roller 8 and the separation pad 9. At this point, a plurality of sheets 3 may be doubly fed because of frictional force among the sheets. The separation pad 9 is provided for preventing such double feed. The leading edge of any doubly fed sheets 3 are subjected to a resistance due to a frictional force between the leading edge and the separation pad 9 so that the doubly fed sheets 3 are separated into single sheets. Any paper power that clings to the separated sheets 3 is removed when the single sheet passes by the paper powder removing rollers 10. The sheets 3 are then conveyed to the registration roller 12 by the conveying rollers 11 opposed to the paper powder removing rollers 10.

The laser beam emitting section (not shown) of the scanner unit 16 generates a laser beam based upon a laser drive signal generated by an engine controller (not shown). The laser beam falls incident on the polygon mirror 19. The polygon mirror 19 provides the laser beam with a scan movement in a main scanning direction (direction perpendicular to the conveying direction of the sheet 3) while reflecting the laser beam toward the fθ lens 20. The fθ lens 20 converts the laser beam to a constant angular speed. Then, the reflecting mirror 21 reflects the laser beam toward the lens 22, which converges the laser beam to focus on the surface of the photosensitive drum 27.

The Scorotron charger 29 charges the surface of the photosensitive drum 27 to, for example, a surface potential of approximately 1000 V. The laser beam from the scanner unit 16 scans across the surface of the photosensitive drum 27 in the main scan direction. The laser beam selectively exposes and does not expose the surface of the photosensitive drum 27 based on the laser drive signal described above. That is, portions of the surface of the photosensitive drum 27 that are to be developed are exposed by the laser light and portions that are not to be developed are not exposed. The surface potential of the photosensitive drum 27 decreases to, for example, approximately 100V at exposed portions, also referred to as bright parts. Because the photosensitive drum 27 rotates counterclockwise as indicated by an arrow in FIG. 4 at this time, the laser beam also exposes the photosensitive drum 27 in an auxiliary scanning direction, which is also the conveying direction of the sheet 3. As a result of the two scanning actions, an electrical invisible image, that is, an electrostatic latent image is formed on the surface of the photosensitive drum 27 from exposed areas and unexposed areas, which are also referred to as dark parts.

The toner in the toner box 34 is supplied to the developing roller 31 according to the rotation of the supply roller 33. At this point, the toner is frictionally charged positively between the supply roller 33 and the developing roller 31 and is further regulated to a layer with constant thickness on the developing roller 31. A positive bias of, for example, approximately 300 to 400 V is applied to the developing roller 31. The toner, which is carried on the developing roller 31 and charged positively, is transferred to the electrostatic latent image formed on the surface of the photosensitive drum 27 when the toner comes into contact with the photosensitive drum 27. That is, because the potential of the developing roller 31 is lower than the potential of the dark parts (+1000 V) and higher than the potential of the bright parts, the positively-charged toner moves selectively to the bright parts where the potential is lower. In this way, a visible image of toner is formed on the surface of the photosensitive drum 27 and development is performed.

The registration rollers 12 perform a registration operation on the sheet 3 to deliver the sheet 3 so that the front edge of the visible image formed on the surface of the rotating photosensitive drum 27 and the leading edge of the sheet 3 coincide with each other. A negative bias is applied to the transfer roller 30 while the sheet 3 passes between the photosensitive drum 27 and the transfer roller 30. The negative bias is approximately −200 V in the present embodiment. Because the negative bias that is applied to the transfer roller 30 is lower than the potential of the bright part (+100 V), the toner electrostatically adhered to the surface of the photosensitive drum 27 moves toward the transfer roller 30. However, the toner is blocked by the sheet 3 and cannot transfer to the transfer roller 30. As a result, the toner is transferred onto the sheet 3. That is, the visible image formed on the surface of the photosensitive drum 27 is transferred onto the sheet 3.

Then, the sheet 3 having the toner transferred thereon is conveyed to the fixing device 18. Residual charges of the toner and the sheet 3 are removed by the grounded charge removing plate 107 when the sheet 3 passes by. Then, the heating roller 41 of the fixing device 18 applies heat of approximately 200 degrees, and the pressing roller 42 applies a pressure, to the sheet 3 with the toner image to fix the toner image permanently on the sheet 3. Note that the heating roller 41 and the pressing roller 42 are each grounded through diodes so that the surface potential of the pressing roller 42 is lower than the surface potential of the heating roller 41. Accordingly, the positively charged toner that clings to the heating roller 41 side of the sheet 3 is electrically attracted to the lower surface potential of the pressing roller 42. Therefore, the potential problem of the toner image being distorted because the toner is attracted to the heating roller 41 at the time of fixing is prevented.

The sheet 3 with the fixed toner image is conveyed on the sheet delivery path 44 by the sheet delivery roller 45 and is delivered to the sheet delivery tray 46 with a toner image side facing downward. Similarly, the sheet 3 to be printed next is stacked over the earlier delivered sheet 3 with a printed surface facing downward in the delivery tray 46. In this way, a user can obtain the sheets 3 aligned in the order of printing.

The operation of the smooth curved surface at the freed end of the temperature sensors 160 and 161 will be described with reference to FIG. 22. As shown in FIG. 22, the surface of the heating roller 41 moves in the direction from the connecting section 165*a* to the contact section 165*b* of the temperature sensors 160 and 161 during a printing process. As mentioned previously, the heating roller 41 applies heat to melt and liquefy the toner that clings to the surface of the sheet 3. Although most of the liquefied toner remains on the surface of the sheet 3 to cool and form the permanent toner image, a small amount of liquefied toner can cling to the surface of the heating roller 41. Rotation of the heating roller 41 moves such toner through the contact position between the heating roller 41 and contact plate 165. At this time, the liquefied toner on the surface of the heating roller 41 can cling to the lower surface of the contact plate 165. However, the residual toner is transferred back to the surface of the heating roller 41 and subsequently to the pressing roller 42 before the liquefied toner can accumulate on the lower surface of the contact plate 165 to any great extent. This is because the surface of the contact plate 165 from the contact section 165*b* to the side edge 165*h* is a smooth curved surface without an edge portion or corner that can trigger the growth of a clump of toner. Once the toner is transferred to the pressing roller 42, the cleaning rollers 154 clean the toner from the pressing roller 42.

The temperature detecting element 164 measures the surface temperature of the heating roller 41 through the contact plate 165. As described above, the resistance value in the temperature detecting element 164 varies according to temperature. Hence, the surface of the heating roller 41 can be maintained at a temperature optimal for printing by adjusting the voltage applied to the halogen lamps 41*a* and 41b based on the value of the current flowing through the temperature detecting element 164.

As described above, the side edges 165*f*, 165*g*, and 165*h* bend away from the surface of the heating roller 41 where they connect with the contact section 165*b*. As a result, the outer surfaces where the side edges 165*f*, 165*g*, and 165*h* connect with the contact section 165*b* are curved. Accordingly, no sharp edges or corner portions that can lead to the accumulation of toner are present on the contact section 165*b*. Hence, even if toner that clings to the surface of the heating roller 41 is transferred to the contact plate 165, the toner will move back to the lower surface of the heating roller 41 before accumulating on the lower surface of the contact plate 165.

The temperature detecting element 164 is fixed at approximately the center of the contact section 165*b*. Also, the free edge of the contact plate 165 is separated from the lower surface of the contact plate 165, that is, in the thickness direction of the contact plate 165, by a distance that is two times or greater the thickness of the contact plate 165. Hence, because the contact plate 165 is supported to contact the heating roller 41 at a position that corresponds to the temperature detecting element 164, the surface temperature of the heating roller 41 can be reliably detected using the temperature detecting element 164. Also, the free edge of the contact plate 165 is separated by a sufficient distance in the thickness direction from the surface of the heating roller 41. Edges of the contact plate 165 that can cause accumulation of foreign matter are sufficiently separated from the heating roller 41 so that toner or other foreign matter remaining on the surface of the heating roller 41 will not accumulate on these edges of the contact plate 165 and form a clump.

While the invention has been described in detail with reference to specific embodiments thereof, it would be apparent to those skilled in the art that many modifications and variations may be made therein without departing from the spirit of the invention, the scope of which is defined by the attached claims.

Figure 23:
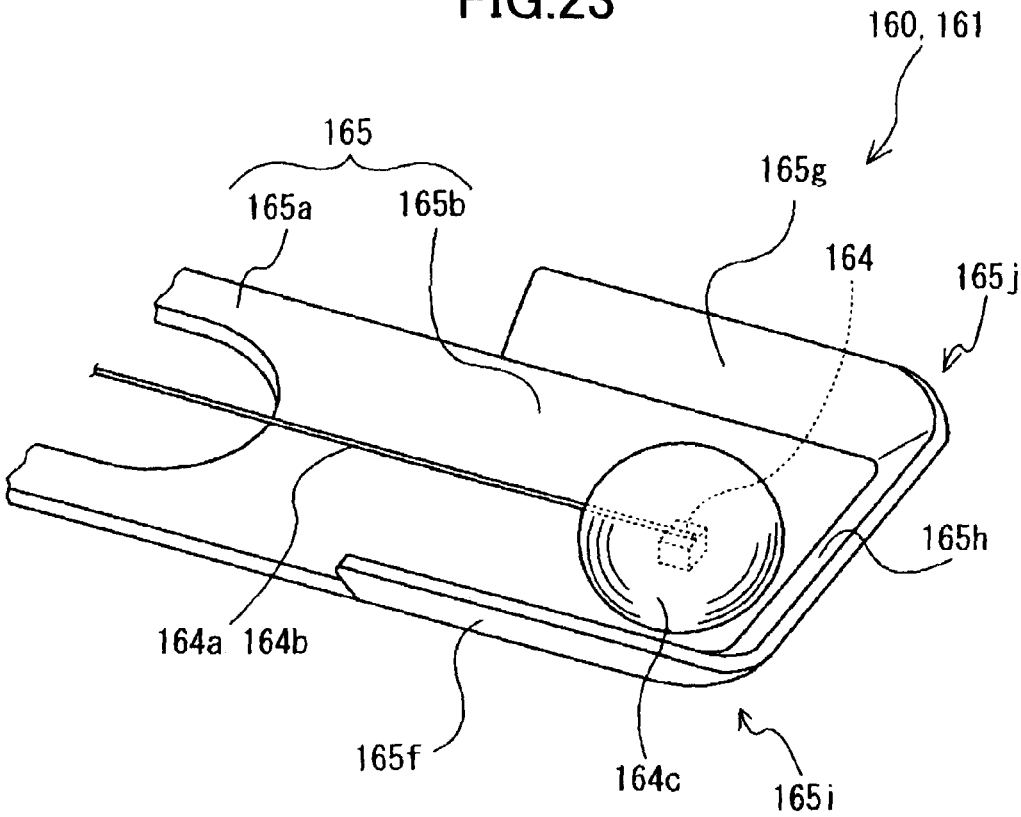
FIG. 23 is an enlarged perspective view showing a variation of the end portion of the temperature sensor of the embodiment.

For example, the embodiment describes the temperature detecting element 164 as being fixed at the center of the contact section 165*b*. However, as shown in FIG. 23, the temperature detecting element 164 can be fixed at a position nearer the side edge 165*h*.

Figure 24:
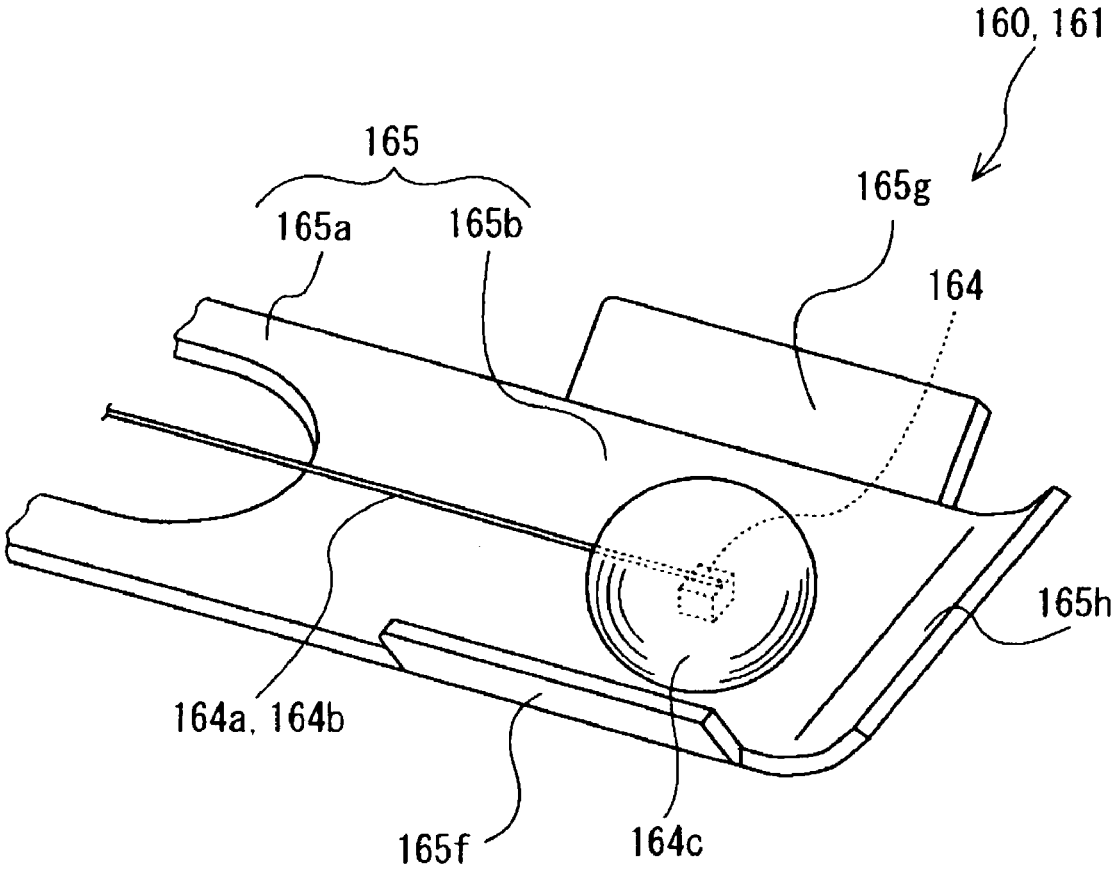
FIG. 24 is an enlarged perspective view showing another variation of the end portion of the temperature sensor of the embodiment.

Further, the embodiment describes the wall surrounding the periphery of the contact section 165*b* as being continuous because of the corner sections 165*i*, 165*j*. However, as shown in FIG. 24, the wall surrounding the periphery of the contact section 165*b* need only include the side edges 165*f*, 165*g*, and 165*h*.

Still further, the embodiment describes the continuous wall forming an acute angle of 45 degrees with respect to the imaginary plane defined by the lower surface of the contact section 165*b*. However, the acute angle of inclination formed by the side edges 165*f*, 165*g*, and 165*h* in relation to the plane of the contact section 165*b* may be set optionally to any angle in a range greater than 0 and less than 90 degrees. Because the angle of inclination of the side edges 165*f*, 165*g*, and 165*h* is an acute angle, there will be not areas that can lead to the accumulation of toner or other foreign matter.

What is claimed is:

1. A heat fixing device for fixing a medium to another medium, the heat fixing device comprising:

an attachment member;

a thermal fixing member that generates heat for thermally fixing the medium to the other medium; and a temperature sensor including:

a substantially rigid support member having an attachment section, a contact section, and a bend, the attachment section and the bend being on opposite ends of the contact section, the contact section having an upper surface and a lower surface that are opposite surfaces of the contact section and that are separated from each other in a direction from the lower surface to the upper surface of the contact section, the attachment section being attached to the attachment member with the lower surface of the contact section in contact with the thermal fixing member, the bend having a lower surface that slants away from the lower surface of the contact section in the direction from the lower surface to the upper surface of the contact section, the lower surface of the bend and the lower surface of the contact section forming a rounded corner portion; and a temperature detecting element for detecting the temperature of the thermal fixing member, the temperature detecting element being fixed on the support member.

2. The heat fixing device as claimed in claim 1, wherein the fixing member has an outer surface that contacts the lower surface of the contact section, the fixing member being rotatable to move the outer surface in a direction from the attachment section to the contact section of the temperature sensor at a position where the outer surface of the fixing member contacts the lower surface of the contact section.

3. The heat fixing device as claimed in claim 2, wherein the lower surface of the contact section is substantially flat and the lower surface of the contact section contacts the fixing member at a position separated from the bend by a predetermined distance in the direction from the attachment section to the contact section of the temperature sensor.

4. The heat fixing device as claimed in claim 1, wherein the fixing member is a heating roller and the temperature detecting element of the temperature sensor is fixed on the upper surface of the support member at a position corresponding to where the bottom surface of the contact section contacts the heating roller.

5. An image forming device for forming a developer image on a recording medium, the image forming device comprising:

a processing unit that transfers the developer image onto the recording medium; and a heat fixing device for fixing the developer image on the recording medium, the heat fixing device including:

an attachment member;

a thermal fixing member that generates heat for thermally fixing the developer image on the recording medium; and a temperature sensor including:

a substantially rigid support member having an attachment section, a contact section, and a bend, the attachment section and the bend being on opposite ends of the contact section, the contact section having an upper surface and a lower surface that are opposite surfaces of the contact section and that are separated from each other in a direction from the lower surface to the upper surface of the contact section, the attachment section being attached to the attachment member with the lower surface of the contact section in contact with the thermal fixing member, the bend having a lower surface that slants away from the lower surface of the contact section in the direction from the lower surface to the upper surface of the contact section, the lower surface of the bend and the lower surface of the contact section forming a rounded corner portion; and a temperature detecting element for detecting the temperature of the thermal fixing member, the temperature detecting element being fixed on the support member.

6. The image forming device as claimed in claim 5, wherein the fixing member is elongated in an axial direction, the processing unit transferring the developer image onto the recording medium and the fixing member fixing the developer image onto the recording medium within a predetermined range in the axial direction, the temperature sensor contacting the fixing member within the predetermined range in the axial direction.

7. A temperature sensor that is attached to an attachment member and used in contact with an object, the temperature sensor comprising:

a support member including an attachment section, a contact section, and a bend, the attachment section and the bend being on opposite ends of the contact section, the attachment section being for attaching to the attachment member, the contact section having an upper surface and a lower surface that are opposite surfaces of the contact section and that are separated from each other in a direction from the lower surface to the upper surface of the contact section, the lower surface of the contact section being for contacting the object, the bend having a lower surface that slants away from the lower surface of the contact section in the direction from the lower surface to the upper surface of the contact section; and a temperature detecting element for detecting the temperature of the object, the temperature detecting element being fixed on the support member, wherein the upper surface and the lower surface of the contact section are separated by a first distance in the direction from the lower surface to the upper surface of the contact section, the bend further having a connected end and free edge at opposite ends thereof, the connected end being integrally connected to the contact section, the free edge being separated from the lower surface of the contact section in the direction from the lower surface to the upper surface of the contact section by a second distance that is two times or greater than the first distance.

8. The temperature sensor as claimed in claim 7, wherein the lower surface of the bend is continuous with the lower surface of the contact section, the lower surface of the bend slanting away from the lower surface of the contact section in a curve.

9. The temperature sensor as claimed in claim 7, wherein the temperature detecting element is fixed on the upper surface of the contact section of the support member.

10. The temperature sensor as claimed in claim 7, wherein the temperature detection element is separated from the bend by a predetermined distance in a direction from the bend to the attachment section.

11. The temperature sensor as claimed in claim 7, wherein the lower surface of the bend extends at an angle that is greater than 0 degrees and less than 90 degrees with respect to the lower surface of the contact section.

12. The temperature sensor as claimed in claim 7, wherein the contact section further has sides extending substantially in a direction from the contact section to the bend, the support member further including side bends that extend from the sides of the contact section, the side bends each having a lower surface that slants away from the lower surface of the contact section in the direction from the lower surface to the upper surface of the contact section.

13. The temperature sensor as claimed in claim 12, wherein the support member further includes connecting parts that integrally connect the side bends to the bend.

14. The temperature sensor as claimed in claim 13, wherein the connecting parts have outer surfaces that are continuous with the lower surfaces of the side bends, the outer surface of each connecting part being curved.

15. The temperature sensor as claimed in claim 7, wherein the lower surface of the bend and the lower surface of the contact section form a rounded corner portion.

16. A temperature sensor that is attached to an attachment member and used in contact with an object, the temperature sensor comprising:

a support member including an attachment section, a contact section, and a bend, the attachment section and the bend being on opposite ends of the contact section, the attachment section being for attaching to the attachment member, the contact section having an upper surface and a lower surface that are opposite surfaces of the contact section and that are separated from each other in a direction from the lower surface to the upper surface of the contact section, the lower surface of the contact section being for contacting the object, the bend having a lower surface that slants away from the lower surface of the contact section in the direction from the lower surface to the upper surface of the contact section; and a temperature detecting element for detecting the temperature of the object, the temperature detecting element being fixed on the support member, wherein the contact section further has sides extending substantially in a direction from the contact section to the bend, the support member further including side bends that extend from the sides of the contact section, the side bends each having a lower surface that slants away from the lower surface of the contact section in the direction from the lower surface to the upper surface of the contact section.

17. The temperature sensor as claimed in claim 16, wherein the upper surface and the lower surface of the contact section are separated by a first distance in the direction from the lower surface to the upper surface of the contact section, the bend further having a connected end and free edge at opposite ends thereof, the connected end being integrally connected to the contact section, the free edge being separated from the lower surface of the contact section in the direction from the lower surface to the upper surface of the contact section by a second distance that is two times or greater than the first distance.

18. The temperature sensor as claimed in claim 16, wherein the support member further includes connecting parts that integrally connect the side bends to the bend.

19. The temperature sensor as claimed in claim 18, wherein the connecting parts have outer surfaces that are continuous with the lower surfaces of the side bends, the outer surface of each connecting part being curved.

20. The temperature sensor as claimed in claim 16, wherein the lower surface of the bend is continuous with the lower surface of the contact section, the lower surface of the bend slanting away from the lower surface of the contact section in a curve.

21. The temperature sensor as claimed in claim 16, wherein the temperature detecting element is fixed on the upper surface of the contact section of the support member.

22. The temperature sensor as claimed in claim 16, wherein the temperature detection element is separated from the bend by a predetermined distance in a direction from the bend to the attachment section.

23. The temperature sensor as claimed in claim 16, wherein the lower surface of the bend extends at an angle that is greater than 0 degrees and less than 90 degrees with respect to the lower surface of the contact section.

24. The temperature sensor as claimed in claim 16, wherein the support member further includes connecting parts that integrally connect the side bends that extend from the sides of the contact section of the support member to the bend.

25. The temperature sensor as claimed in claim 24, wherein the connecting parts have outer surfaces that are continuous with the lower surfaces of the side bends, the outer surface of each connecting part being curved.

26. The temperature sensor as claimed in claim 16, wherein the lower surface of the bend and the lower surface of the contact section form a rounded corner portion.

* * * * *